US009540799B2

(12) United States Patent
Allard

(10) Patent No.: US 9,540,799 B2
(45) Date of Patent: Jan. 10, 2017

(54) MODULAR STORM WATER FILTRATION SYSTEM

(75) Inventor: Douglas Paul Allard, Occidental, CA (US)

(73) Assignee: Oldcastle Precast, Inc., Atlanta, GA (US)

( * ) Notice: Subject to any disclaimer, the term of this patent is extended or adjusted under 35 U.S.C. 154(b) by 131 days.

(21) Appl. No.: 13/263,291

(22) PCT Filed: Apr. 7, 2010

(86) PCT No.: PCT/US2010/030206

§ 371 (c)(1), (2), (4) Date: Oct. 6, 2011

(87) PCT Pub. No.: WO2010/118110

PCT Pub. Date: Oct. 14, 2010

(65) Prior Publication Data

US 2012/0031854 A1 Feb. 9, 2012

Related U.S. Application Data

(60) Provisional application No. 61/167,746, filed on Apr. 8, 2009.

(51) Int. Cl.
*E03F 5/14* (2006.01)
*E03F 5/10* (2006.01)
(Continued)

(52) U.S. Cl.
CPC . *E03F 5/14* (2013.01); *E03F 1/00* (2013.01); *E03F 5/0404* (2013.01); *E03F 5/101* (2013.01)

(58) Field of Classification Search
CPC . B01D 21/02; B01D 21/0003; B01D 21/0033; B01D 21/0006; B01D 21/0012; B01D 21/0039;B01D 21/0042; B01D 222/12; B01D 29/00; B01D 29/33; B01D 29/52; B01D 29/56; B01D 2201/10; C02F 2103/001; C02F 1/004; C02F 1/281; C02F 1/283; C02F 2307/08; C02F 2201/0006; C02F 2301/043; C02F 2101/30; C02F 2101/32; C02F 2209/42; C02F 9/00; C03F 2005/02; E03F 5/12; E03F 5/14; E03F 5/16; E03F 5/101; E03F 5/106; E03F 5/0404; E03F 1/00; E03F 1/002; E03F 1/003; E03F 1/005; E02B 85/085
(Continued)

(56) References Cited

U.S. PATENT DOCUMENTS 3,770,623 A 11/1973 Seidel
4,537,687 A * 8/1985 Piper ..... 210/793
(Continued)

FOREIGN PATENT DOCUMENTS

WO WO 2010/118110 10/2010

OTHER PUBLICATIONS

Merriam-Webster, "Front" definition (m-w.com, accessed Oct. 19, 2014), 4 pages.*
(Continued)

*Primary Examiner* — Bobby Ramdhanie
*Assistant Examiner* — Patrick Orme

(57) ABSTRACT

The invention provides systems, associated component parts, and assemblies of the pre-filtration systems, that are useful for treating storm water entering underground storm water management systems. The invention further provides methods to pre-filter storm water prior to entering underground water management systems. The invention reduces pollutant loading in storm water runoff with minimal footprint, flexibility of use and ease of maintenance.

49 Claims, 21 Drawing Sheets

(51) Int. Cl.
*E03F 1/00* (2006.01)
*E03F 5/04* (2006.01)

(58) Field of Classification Search
USPC ..... 52/169.2, 169.6; 210/163, 164, 170.03, 210/253, 254, 259, 260, 261, 262, 306, 747.2, 210/747.3, 800, 802, 806; 404/2, 4
See application file for complete search history.

(56) References Cited

U.S. PATENT DOCUMENTS

| | | | | |
|---|---|---|---|---|
| 5,322,629 | A | 6/1994 | Stewart | |
| 5,437,786 | A | 8/1995 | Horsley | |
| 5,549,817 | A | 8/1996 | Horsley | |
| 5,569,387 | A * | 10/1996 | Bowne et al. | 210/754 |
| 5,624,576 | A | 4/1997 | Lenhart | |
| 5,702,593 | A | 12/1997 | Horsley | |
| 5,707,527 | A | 1/1998 | Knutson | |
| 5,728,305 | A | 3/1998 | Hawkinson | |
| 5,744,048 | A * | 4/1998 | Stetler | 210/803 |
| 5,759,415 | A | 6/1998 | Adams | |
| 5,788,848 | A | 8/1998 | Blanche | |
| 5,985,157 | A | 11/1999 | Leckner | |
| 6,027,639 | A | 2/2000 | Lenhart, Jr. | |
| 6,077,423 | A | 6/2000 | Roy et al. | |
| 6,132,603 | A | 10/2000 | Mokrzycki | |
| 6,277,274 | B1 * | 8/2001 | Coffman | 210/150 |
| 6,350,374 | B1 | 2/2002 | Stever | |
| 6,406,218 | B1 | 6/2002 | Olson | |
| 6,511,595 | B2 | 1/2003 | Crompton | |
| 6,569,321 | B2 | 5/2003 | Coffman | |
| 6,641,720 | B1 | 11/2003 | Crompton | |
| 6,649,048 | B2 | 11/2003 | de Ridder | |
| 6,676,832 | B2 | 1/2004 | de Bruijn et al. | |
| 6,783,683 | B2 | 8/2004 | Collings | |
| 6,905,599 | B2 | 6/2005 | Allard | |
| 6,939,461 | B2 | 9/2005 | Use et al. | |
| 6,991,114 | B2 | 1/2006 | Allen, II | |
| 6,991,402 | B2 | 1/2006 | Burkhart | |
| 6,991,734 | B1 | 1/2006 | Smith et al. | |
| 6,998,038 | B2 * | 2/2006 | Howard | 210/111 |
| 7,022,243 | B2 | 4/2006 | Bryant | |
| 7,160,058 | B2 | 1/2007 | Burkhart | |
| 7,186,058 | B2 | 3/2007 | Schluter | |
| 7,186,333 | B2 | 3/2007 | Kluge | |
| 7,237,981 | B1 * | 7/2007 | Vitarelli | 405/42 |
| 7,296,692 | B2 | 11/2007 | Allen, II | |
| 7,297,266 | B2 | 11/2007 | Cobb | |
| 7,344,335 | B2 | 3/2008 | Burkhart | |
| 7,425,261 | B2 | 9/2008 | Siviter | |
| 7,425,262 | B1 | 9/2008 | Kent | |
| 7,470,362 | B2 | 12/2008 | Kent | |
| 7,517,450 | B2 | 4/2009 | Hersey et al. | |
| 7,625,485 | B2 | 12/2009 | Siviter | |
| 7,638,065 | B2 * | 12/2009 | Stever et al. | 210/747.3 |
| 7,638,066 | B1 | 12/2009 | Jacob et al. | |
| 7,674,378 | B2 | 3/2010 | Kent | |
| 7,776,217 | B2 | 8/2010 | Lucas | |
| 7,798,747 | B1 | 9/2010 | de Bruijn et al. | |
| 7,799,235 | B2 | 9/2010 | Olson et al. | |
| 7,833,412 | B2 | 11/2010 | Holtz | |
| 7,985,335 | B2 | 7/2011 | Allard | |
| 8,110,105 | B2 | 2/2012 | Allen, II | |
| 8,147,688 | B2 | 4/2012 | Adams et al. | |
| 8,501,016 | B2 | 8/2013 | Lord et al. | |
| 8,535,533 | B2 | 9/2013 | Allard | |
| 2004/0226869 | A1 * | 11/2004 | McClure et al. | 210/163 |
| 2007/0068878 | A1 | 3/2007 | Stever | |
| 2008/0121594 | A1 * | 5/2008 | Dierkes | 210/788 |
| 2008/0217227 | A1 | 9/2008 | Pank | |
| 2008/0217257 | A1 | 9/2008 | Pank | |
| 2008/0251448 | A1 | 10/2008 | Kent | |
| 2009/0050583 | A1 * | 2/2009 | Arnott et al. | 210/801 |
| 2009/0218299 | A1 * | 9/2009 | Cote et al. | 210/791 |
| 2009/0250405 | A1 | 10/2009 | Allard | |
| 2010/0206790 | A1 | 8/2010 | Holtz | |
| 2011/0147303 | A1 | 6/2011 | Allard | |
| 2011/0186492 | A1 | 8/2011 | Holtz | |
| 2012/0152827 | A1 | 6/2012 | Allard | |

OTHER PUBLICATIONS

Merriam-Webster, "Back" definition (m-w.com, accessed Oct. 19, 2014), 5 pages.*

PCT, International Search Report for International Application No. PCT/US 10/30206, Date of Mailing: Jun. 10, 2010.

PCT, Notification Concerning Transmittal of International Preliminary Report on Patentability (Chapter I of the Patent Cooperation Treaty) for International Application No. PCT/US2010/030206, Date of Mailing: Oct. 20, 2011.

Contech Construction Products Inc., UrbanGreen™ BioFilter Design, Operation and Performance, 2009.

Contech Construction Products Inc., UrbanGreen™ BioFilter Specification, Apr. 2009.

Contech Construction Products Inc., Urbangreen Biofilter UGBF0406 Standard Detail, with date Dec. 2, 2010.

Contech Construction Products Inc., Urbangreen Biofilter UGBF0406-NC Standard Detail, with date Dec. 2, 2010.

Contech Construction Products Inc., Urbangreen Biofilter UGBF0608 Standard Detail, with date Dec. 2, 2010.

Contech Construction Products Inc., Urbangreen Biofilter UGBF0608-NC Standard Detail, with date Dec. 2, 2010.

Contech Construction Products Inc., Urbangreen Biofilter UGBF0612 Standard Detail, with date Dec. 2, 2010.

Contech Construction Products Inc., Urbangreen Biofilter UGBF0612-NC Standard Detail, with date Dec. 2, 2010.

Contech Construction Products Inc., Urbangreen Biofilter UGBF0816 Standard Detail, with date Dec. 2, 2010.

Contech Construction Products Inc., Urbangreen Biofilter UGBF0816-NC Standard Detail, with date Dec. 2, 2010.

Third-Party Preissuance Submission Under 37 CFR 1.290 filed in the USPTO on Oct. 30, 2012 in connection with U.S. Appl. No. 13/214,230.

Third-Party Preissuance Submission Under 37 CFR 1.290 filed in the USPTO on Feb. 4, 2013 in connection with U.S. Appl. No. 13/214,230.

Office Action mailed on Dec. 27, 2012 in connection with U.S. Appl. No. 12/977,015.

USPTO Office Action in U.S. Appl. No. 13/214,230, notification date: Apr. 15, 2014 (13 pages).

Response to Office Action for U.S. Appl. No. 13/214,230, dated Jul. 14, 2014 (14 pages).

PCT Notification of Transmittal of the International Search Report and the Written Opinion of the International Searching Authority, or the Declaration for International Application No. PCT/US2014/042077, date of mailing: Aug. 12, 2014 (11 pages).

U.S. Patent and Trademark Office, Office Action mailed on Jun. 26, 2015 in connection with U.S. Appl. No. 13/960,689.

* cited by examiner

2' x 2' Inlet Bay w/Manhole Cover and 2' x 2' Pod (Single 18" Cartridge)

2' x 4' Inlet Bay w/Manhole Cover and 2' x 4' Pod

2' x 2' Inlet Bay w/Manhole Cover and 4' x 2' Pod (Two 18" Cartridges)

2' x 4'Inlet Bay w/Manhole Cover and 4' x 4' Pod

4' x 4'Inlet Bay w/Manhole Cover and 4' x 4' Pod

2' x 2'Inlet Bay w/Square Inlet Pipe/Grate and 2' x 2' Pod (Single 18" Cartridge)

2' x 2'Inlet Bay w/Square Inlet Pipe/Grate and 4' x 2' Pod (Two 18" Cartridges)

2' x 2'Inlet Bay w/Square Inlet Grate and 2' x 2' Pod (Single 18" Cartridge)

2' x 2' Inlet Bay w/Manhole Cover and 2' x 2' Pod (Single 18" Cartridge)

1} SHAPE AND SIZE TO ACCEPT BOTTOM SURFACE OF INLET POD OR FILTER POD ASSEMBLY.

2} SIZE TO SLIP CONNECT TO RISER PIPE. GASKET CONNECTION OR FLEXIBLE CONNECTOR PREFERRED.

OUTLET ADAPTER PAN FOR PIPE OR CHAMBER WATER STORAGE SYSTEM.

* FILTER POD MAY BE CONNECTED TOGETHER WITH CONNECTOR PIPE OR MAYBE CONNECTED BY BOLTING SIDE TO SIDE.

POD ASSEMBLY WITH MULTIPLE FILTER PODS. (PIPE OR CHAMBER SYSTEM APPLICATION)

A

B

MODULAR STORM WATER FILTRATION SYSTEM

CROSS REFERENCE TO RELATED APPLICATIONS

This application claims priority to International Application No. PCT/US2010/030206 filed on Apr. 7, 2010, which claims priority to U.S. Provisional Application Ser. No. 61/167,746 filed on Apr. 8, 2009, the subject matter of which are herein incorporated by reference in their entirety.

FIELD OF THE INVENTION

The invention relates to filtration systems that are used to pre-filter storm water entering underground water management detention or retention systems.

BACKGROUND OF THE INVENTION

Nearly any new development of land must incorporate a system for managing water run-off from the developed land. Current regulatory schemes typically require developers to install underground water detention and/or retention systems that effectively maintain a flow of water into and off of the developed land that mimics the natural (i.e., pre-development) flow from the land.

Such systems typically are installed under large concrete or asphalt surfaces and often must be capable of bearing highly variable weight loads (e.g., a parking lot). Ideally, such systems should maximize water storage while occupying as small a "footprint" as possible in order to minimize land usage.

In addition, urban and suburban landscapes generate a variety of contaminants that can enter storm water, polluting downstream receiving waters. Many regulatory schemes require not only controlling water run-off, but also water quality. Typically, developed land accumulates pollutants that can contaminate water run-off, particularly after storms. The entrance of gross pollutants, such as trash, debris and coarse sediments, into typical storm water filtration systems is known to reduce efficiency, increase maintenance frequency of the storm water filtration systems, and escalate the costs.

Ideally, underground water management systems should pre-treat water flow from the developed land prior to releasing it. Pre-filtration systems may be used to separate and retain gross pollutants from the filtering systems. They also can be used to capture and retain sediment, oils, metals, and other constituents found in storm water. Such pre-filtration systems should be incorporated into the underground water retention or detention system to minimize land usage, but also should be accessible for intermittent cleaning, repair, and/or other maintenance.

Generally, large (normally pre-cast concrete) pre-filtration structures are installed next to or along the side of the underground water detention or retention system. The pre-filtration structures are connected to the underground water detention or retention system by piping. This type of pre-filtration structure requires additional material and labor costs. It also requires the use of more space to accommodate the pre-treatment structure that sits next to or along the side of the underground water detention or retention system.

SUMMARY OF THE INVENTION

The present invention provides for a modular pre-filtration system installed at least partially above a storm water retention or detention system (also known as metering system). The pre-filtration system may be used anywhere requiring filtration and hydromodification of storm water, for example in commercial, industrial, or residential settings.

The present invention allows for the treatment of storm water before it enters one or more underground storm water retention or detention systems, while reducing or eliminating much of the related storm drain piping that connects the pre-filtration system and the storm water retention or detention system. The elimination or reduction in the piping allows for shallower facilities and less excavation.

In addition, the placement of the pre-filtration system above the storm water retention or detention system can reduce overall space demands. This allows for a significant reduction in the overall "footprint" of the storm water management system. The layout of the pre-filtration system simplifies construction and installation. It also allows for a reduction in the overall cost of the storm water management system.

The present invention facilitates the incorporation of a range of filtration devices into underground water management systems. This allows for the treatment of different storm water flows and contaminants.

The present invention also provides for a modular, scaleable design. The pre-filtration system may include different quantities of the filtration media (filter cartridges) to accommodate different storm water flow rates. The pre-filtration system may include different types of filtration media to treat different levels and types of contamination. The components of the pre-filtration system may be positioned in different configurations above a metering system. This allows the user to place the pre-filtration system with reference to different surface structures and to ensure alignment with surface improvements. The pre-filtration system may also be positioned above different types of metering systems.

In one embodiment, the present invention provides for a pre-filtration system for an underground water management system comprising an inlet chamber comprising an inlet opening; and a filtration chamber connected to the inlet chamber, comprising filtration medium and an outlet opening; wherein at least part of the pre-filtration system is disposed above a storm water detention system.

In another embodiment, the present invention provides for a pre-filtration system for an underground water management system comprising an inlet chamber and a filter chamber, wherein the pre-filtration system is disposed directly above a storm water detention system. The inlet chamber may comprise four side surfaces, a top surface, a bottom surface, and an access opening on at least one of said surfaces for incoming water. The filtration chamber may comprise filtration medium.

The inlet chamber may comprise a high flow bypass system to allow water overflow through openings in the inlet chamber. The high flow bypass system may comprise a baffle comprising at least two vertical walls, one wall being lower than the other wall, and an annular space between the two walls. In one embodiment, the high flow exits through a bypass system underneath the inlet chamber or filtration chamber. In another embodiment, the high flow is directed into a horizontal outlet pipe.

In another embodiment, the present invention provides for a method of pre-filtering storm water. Incoming water flows from the inlet chamber to one or more filtration chambers. The filter chamber can contain filter cartridges (for example, single or multiple stack heights). The inlet and filtration chambers may be connected together by bolts, sealants or pipes (or a combination thereof) in various configurations to add additional filtration capacity. Incoming flows may be directed to different sides of the storage system (split), reducing the size requirement of the filter housing and eliminating related piping.

In another embodiment, the present invention accepts water through one or more incoming pipes. In yet another embodiment, a catch basin chamber accepts surface water through a grate and/or through one or more incoming pipes.

In another embodiment, single or multiple filter chambers may be placed anywhere over the top of the storm water retention or detention system. This allows for alignment with surface improvements.

Removable covers incorporated into the pre-filtration system allow for access to the inlet and filtration chambers for removal of gross pollutants, as well as routine inspection and maintenance of the system. In one embodiment, the removable covers are set directly over the pre-filtration system. In another embodiment, the removable covers are set directly over adjustable risers, which are set over the pre-filtration system. This allows the adjustment of the depth of the system to match the finished surface.

In another embodiment, the at least one of the inlet chamber and filtration chamber is disposed above a pipe manifold system.

In another embodiment, the pre-filtration system can be connected to another pre-filtration system. In this embodiment, an outlet "pan style" adapter is used.

It is contemplated that the dimensions and structural configuration of the filter housings can vary dependent on one or more design factors including but not limited to: desired overall size of the assembly, desired load-bearing tolerance for assembly, desired amount of water flow to be managed, number and location of inlet and outlet pipes, number and location of pre-treatment zones and filtration systems, alignment with surface structures, and/or the desired access space for inspection and maintenance purposes.

BRIEF DESCRIPTION OF THE DRAWINGS

Embodiments of the present invention may be described with reference to the accompanying drawings.

FIG. 1 illustrates a pre-filtration system with a single filtration cartridge in the filtration chamber. FIG. 2 illustrates a filtration system that can include house two filtration cartridges arranged in a lengthwise "row" and a square grated top cover. One filtration cartridge can be located at one end of the filtration chamber (as shown in FIG. 2), while the second filtration cartridge can be located at another end (not shown). FIG. 3 illustrates a pre-filtration system that can include two filtration cartridges placed in a side-by-side, horizontal "row" arrangement. FIG. 4 illustrates a pre-filtration system that can include four filtration cartridges. FIG. 5 illustrates a pre-filtration system with a larger inlet chamber and a filtration chamber that also can include four filtration cartridges.

FIG. 6 illustrates a pre-filtration system with a single filtration cartridge in the filtration chamber. FIG. 7 illustrates a pre-filtration system with two filtration cartridges placed in a side-by-side, horizontal "row" arrangement.

FIG. 19 illustrates the top and cross-sectional views of the embodiment in FIG. 18. Scheme A is the top view of the assembly and depicts the bilateral configuration of the filtration cartridges in relation to the inlet chamber. Scheme B is the cross-sectional view of the assembly and depicts the bilateral configuration of the filtration cartridges in relation to the inlet chamber.

DETAILED DESCRIPTION OF THE INVENTION

Figure 1:
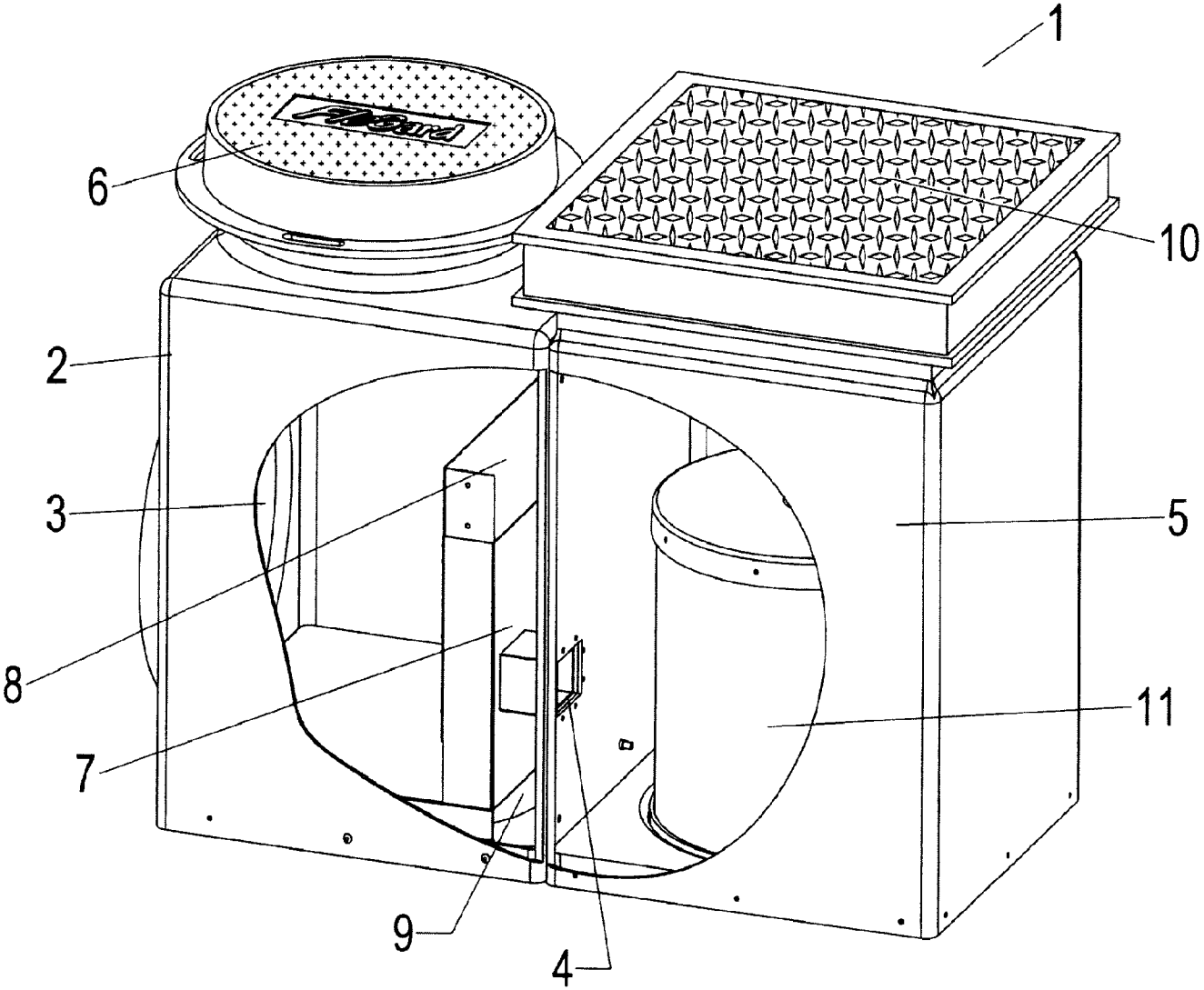
FIGS. 1 through 5 illustrate a cross-sectional angled views of the pre-filtration system in a "vault" assembly. The pre-filtration system has an inlet chamber with a manhole cover and internal components that form a high flow bypass. The pre-filtration system also has an adjacent filtration chamber that can include filtration cartridge(s) and a substantially square cover.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of the "a" or "an" are employed to describe elements and components of the invention. This is done merely for convenience and to give a general sense of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. Although methods similar or equivalent to those described herein may be used in the practice or testing of the present invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

In the following description, numerous specific details are provided, such as the identification of various system components, to provide an understanding of embodiments of the invention. One skilled in the art will recognize, however, that embodiments of the invention may be practiced without one or more of the specific details, or with other methods, components, materials, etc. In still other instances, well-known structures, materials, or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more embodiments.

I. Overview

The present invention provides a pre-filtration system for water management applications. A wide range of water management applications may be addressed using the systems described herein. These include, but are not limited to, all water retention and detention applications (or metering systems), such as those typically addressed with underground caverns, chambers, or cisterns and typically made using simple piping, pre-cast concrete, and/or plastic "milk crate" type assemblies. Particular applications include underground storm water retention and/or detention, rainwater harvesting, and other water run-off related issues.

Figure 12:
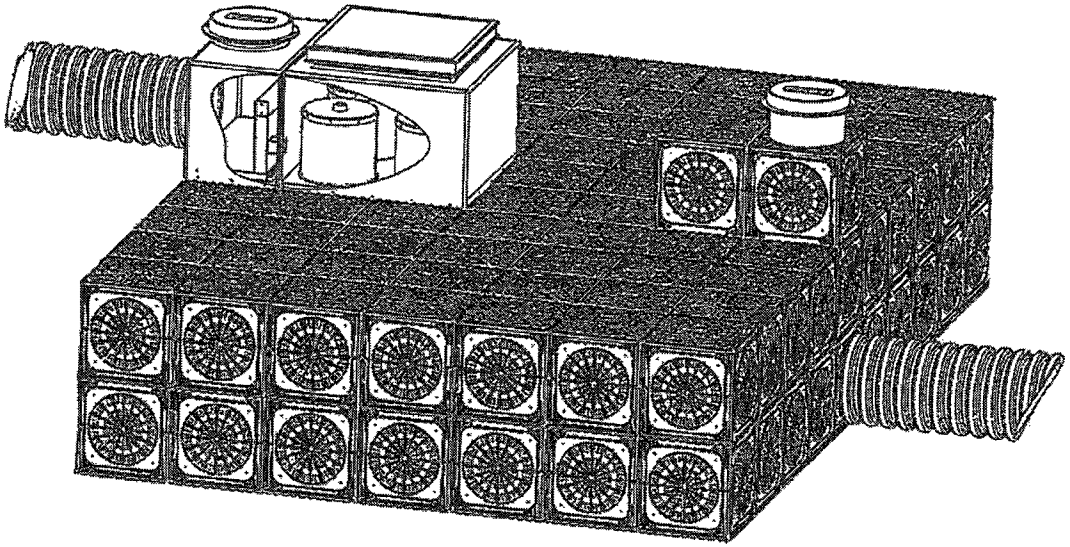
FIG. 12 illustrates the assembly of an embodiment of the pre-filtration system above a water detention or retention system. The pre-filtration system is placed over half cube structures that control or meter storm water flow.
Figure 13:
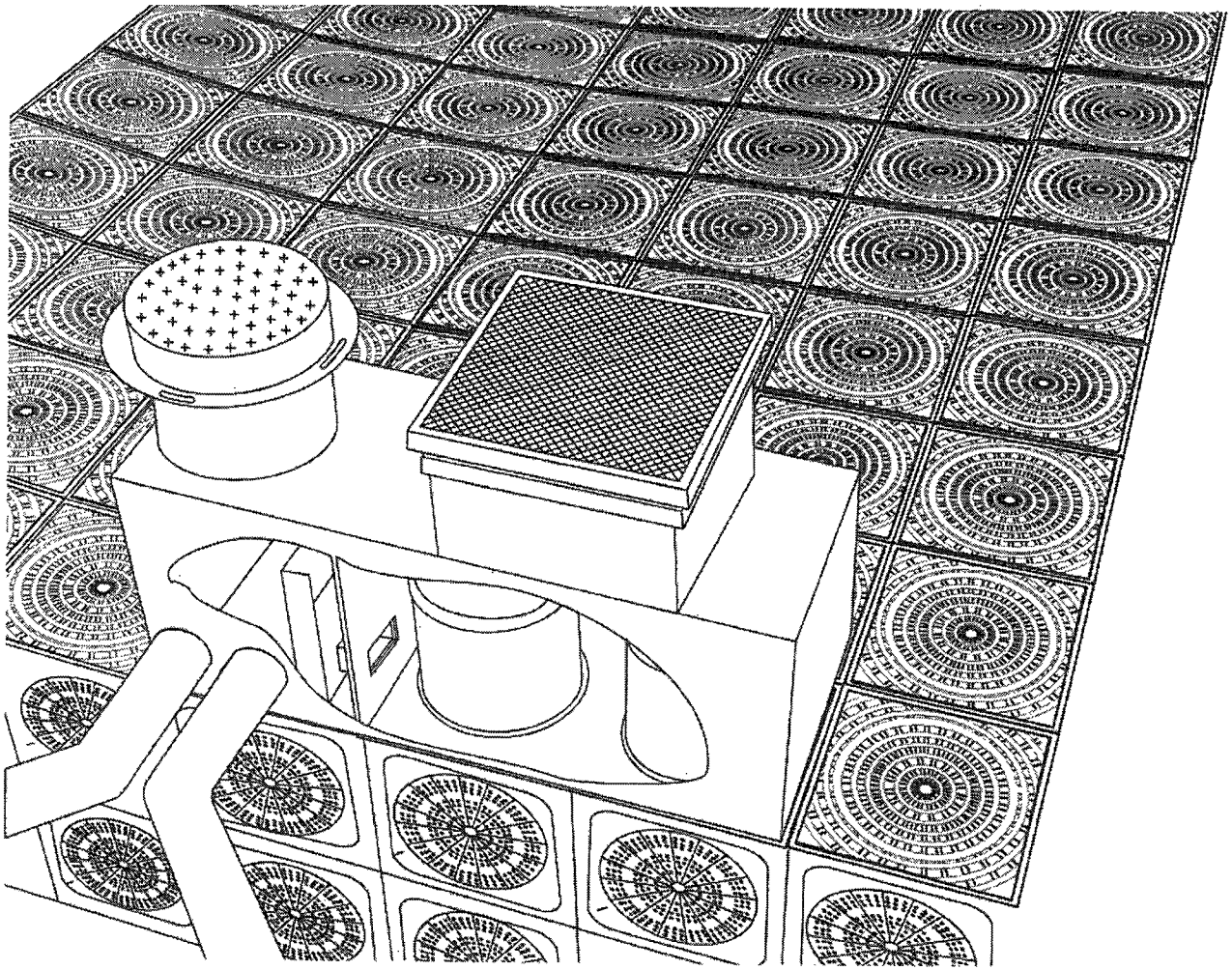
FIG. 13 illustrates a cross-sectional angled view of another embodiment of the pre-filtration system, which is placed over half cube structures that control or meter the flow of the storm water. The inlet chamber of the pre-filtration system receives incoming storm water from multiple pipes.
Figure 17:
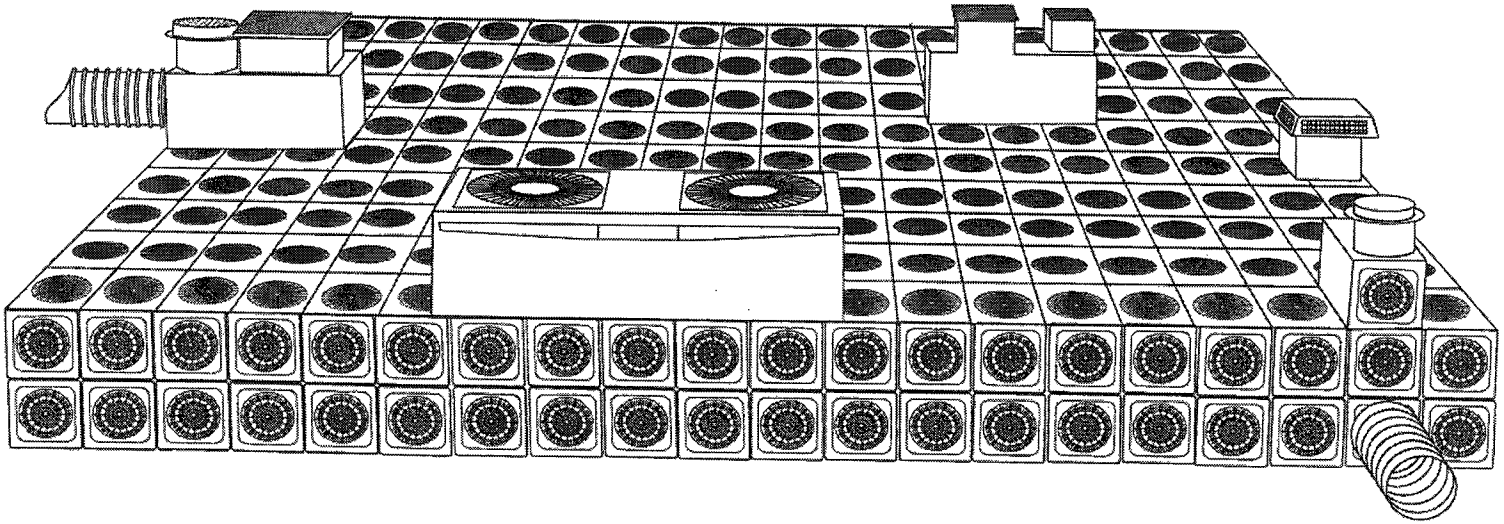
FIG. 17 illustrates the assembly of multiple pre-filtration systems above a water detention or retention system. There is also a grassy swale-pre-filter placed above the water detention or retention system.

The pre-filtration system of the present invention may be installed above a water retention and/or detention system to filter and meter storm water flow as illustrated in FIGS. 12, 13, and 17. The pre-filtration system may be made of stainless steel, fiberglass, concrete or other structurally suitable materials.

The pre-filtration system includes an inlet chamber and filtration chamber. The inlet and filtration chambers may be combined within a single assembly with a common wall or similar partitions at least partially separating the two chambers. Alternatively, the inlet and filtration chambers may be separate structures that are bolted to each other or otherwise connected to each other through a mechanical connection.

The pre-filtration system may be placed over (directly or indirectly) one or more existing metered systems (or water storage and retention systems).

By installing all or at least part of the pre-filtration system over a water retention or detention system, the present invention effectively reduces the size of the "footprint" on the surface. This configuration can also reduce the depth of the underground water management system.

A. The Inlet Chamber

As illustrated in FIG. 1, the pre-filtration system 1 contains an inlet chamber 2 (also referred to as an "inlet bay"). The inlet chamber 2 has four sidewalls, as well as top and bottom surfaces. The inlet chamber 2 may be made of stainless steel or other structurally suitable materials. Storm water enters the inlet chamber 2 from an inlet opening 3 along the sidewall of the pre-filtration system 1. Storm water entering the inlet chamber 2 may contain fine sediments, as well as gross pollutants, such as trash, debris and coarse sediments. At least some portion of these gross pollutants may be retained in the inlet chamber 2. After it enters the inlet chamber, the storm water is directed through one or more tubes or ports 4 into the filtration chamber 5. This "first flush" flow enters the filtration chamber for further treatment.

The inlet chamber 2 also includes an access opening (not shown) located along a surface of the inlet chamber. In a "vault" assembly, the access opening may be a hole with a substantially circular solid manhole cover 6. The manhole cover 6 may be removed to allow for inspection of the inlet chamber. Removal of the manhole cover 6 allows for the periodic maintenance of the pre-filtration system. Gross pollutants may be removed from the inlet chamber 2 by vacuum. This can avoid clogging of the inlet chamber 2. Removal of the gross pollutants can also allow for the continued flow of storm water through the pre-filtration system. FIGS. 1 to 5 illustrate different embodiments with a solid manhole cover 6 above the access opening. As shown in these figures, storm water enters the side of the inlet chamber via one or more incoming pipes. As shown in FIG. 13, the inlet chamber may also include more than one inlet openings in the "vault" configuration.

The inlet chamber can also be designed to accept storm water from different sources. A "catch basin" assembly can include grated top cover panels instead of the solid manhole covers shown in FIGS. 1-5. An exemplary grated cover panel is shown at element 12 in FIGS. 6 and 7. In these embodiments, storm water may enter the inlet chamber through the top surface of the inlet chamber (via a grated top cover panel 12) while also entering through one or more incoming pipes. The pre-filtration system acts as a "catch basin" filtration device. These grated top cover panels may be removed to allow access to the inlet chamber.

Figure 18:
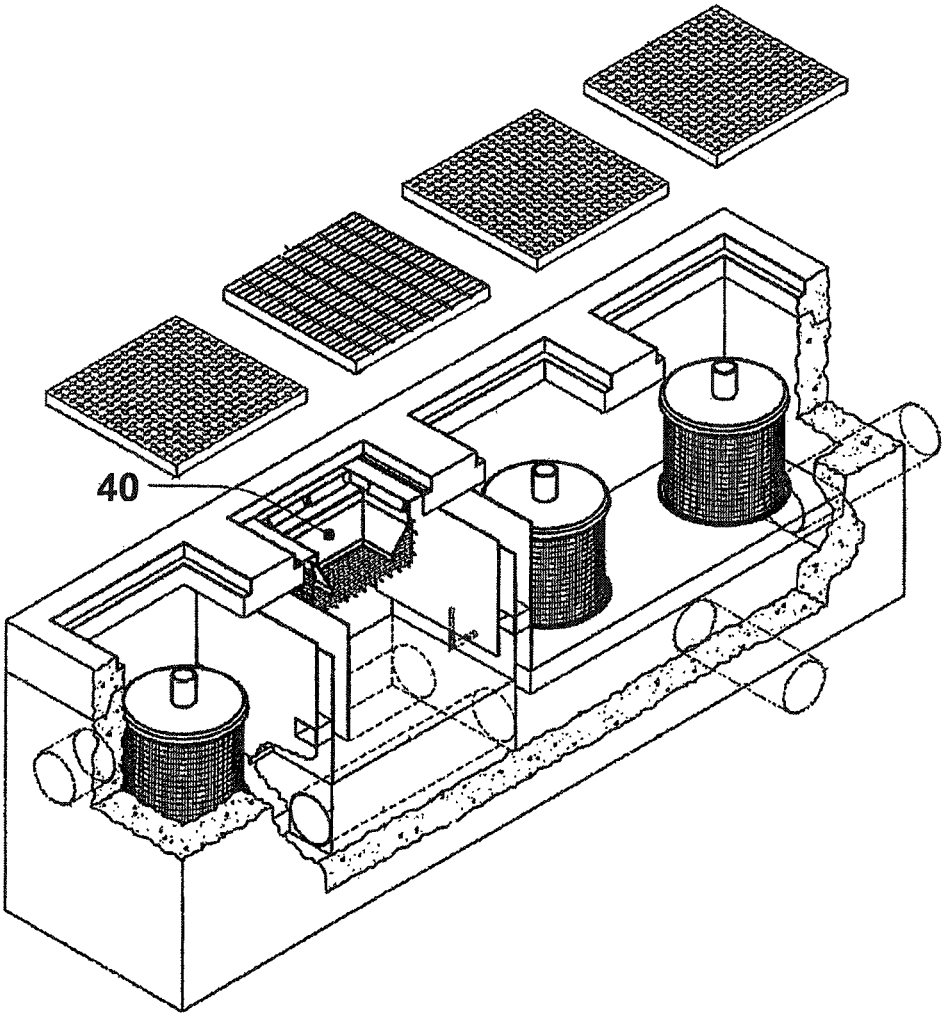
FIG. 18 illustrates the cross-sectional angled view of the pre-filtration system in bilateral configuration. It depicts an assembly with 3 filtration cartridges, placed on both sides of the inlet chamber. A catch basin insert filter, such as that commercially manufactured under the name FLOGARD®+ Plus Pre-Filter (KriStar Enterprises, Inc., Santa Rosa, Calif.), is placed under the inlet grate for additional filtration capacity.

As illustrated in FIG. 18, a grated inlet houses the catch basin insert filter 40, which is commercially manufactured under the name FLOGARD®+Plus Pre-Filter, for capturing debris prior to entering the inlet chamber. When used in conjunction with the catch basin insert filter for capturing debris, a treatment train is established. The catch basin insert filter increases the system's capability for capturing debris and further reduces the periodic maintenance of the pre-filtration system. The FLOGARD®+Plus Pre-Filter is commercially available, and is described in, for example, U.S. Pat. Nos. 6,551,023 and 6,872,029, which are incorporated herein by reference.

B. The Filtration Chamber

As shown in FIG. 1, storm water can flow through a port or tube 4 to the filtration chamber 5 (also referred to as a "filter pod") for treatment. The filtration chamber 5 can include four sidewalls, as well as top and bottom surfaces. As shown in FIG. 1, the filtration chamber 5 is directly adjacent to the inlet chamber 2 so as to equalize flow through the pre-filtration system. The inlet and filtration chambers can be configured, however, in any configuration, provided that there are one or more connections that allow storm water to flow between the chambers.

The filtration chamber 5 also includes an access opening located along a top of the chamber. The access opening may be an opening with a substantially square grate 10. The grate 10 may be removed to allow for inspection of the filtration chamber 5. Removal of the grate 10 allows for the periodic maintenance of the pre-filtration system, such as removal of fine sediment and other pollutants. This avoids clogging of the filtration chamber 5 and allows for the periodic inspection and replacement of filter medium.

This "first flush" entering the filtration chamber 5 may be treated by one or more known filtration devices, including a filter cartridge 11 disposed within the filtration chamber 5. In one embodiment, the filtration chamber contains a cylindrical filtration device, such as the PERK FILTER™ Media Filtration device to capture and retain sediment, oils, metals, and other target constituents (KriStar Enterprises, Inc., Santa Rosa, Calif.). The cylindrical filtration device is manufactured from durable polymeric components with a polymer-coated steel support screen and stainless steel hardware. The filtration device is approximately 18 inches in diameter and contains generally known filtration media, such as activated carbon or zeolites. The filtration media is designed to capture very fine sediments (typically less than about 100 μm), nutrients, metals, oils and grease, organics, and bacteria.

After contacting the filtration media, the filtered flows exit the filtration chamber 5 through an outlet opening in one or more side walls or the bottom surface. The filtered storm water can then be directed to metered filtration systems. The metered filtration system may include a modular underground water management system with an assembly of modular systems. The modular underground water management system may be a substantially cubic or "milk-crate" structure with a solid shell impermeable to water and an arched opening in each of six faces. Passages for water flow extend through the center of the structure to each opposing face, as described in "Modular Underground Water Management System" by Douglas Allard et al., U.S. Application Ser. No. 61/052,574, which is incorporated by reference herein.

C. High Flow Bypass

The pre-filtration system includes a high flow bypass to accommodate periods of increased storm water flow. During such periods, the flow rate of the storm water entering the pre-filtration system exceeds the treatment capacity of the filtration chamber 5.

In one embodiment, an internal bypass system contained within the pre-filtration system may be used. As shown in FIG. 1, storm water that exceeds the capacity of the filtration chamber 5 accumulates in the inlet chamber until it rises to the top of a baffle (or weir). The baffle may be substantially rectangular in shape and have at least two substantially vertical walls, one wall 7 being lower than the other wall 8. There may be an annular space between the two walls 7 and 8. Storm water is allowed to flow vertically into the annular space between the two walls. The storm water is then directed to a bypass outlet opening 9 on the bottom of the inlet chamber or an opening in a side wall (not shown) of the inlet chamber.

Figure 8:
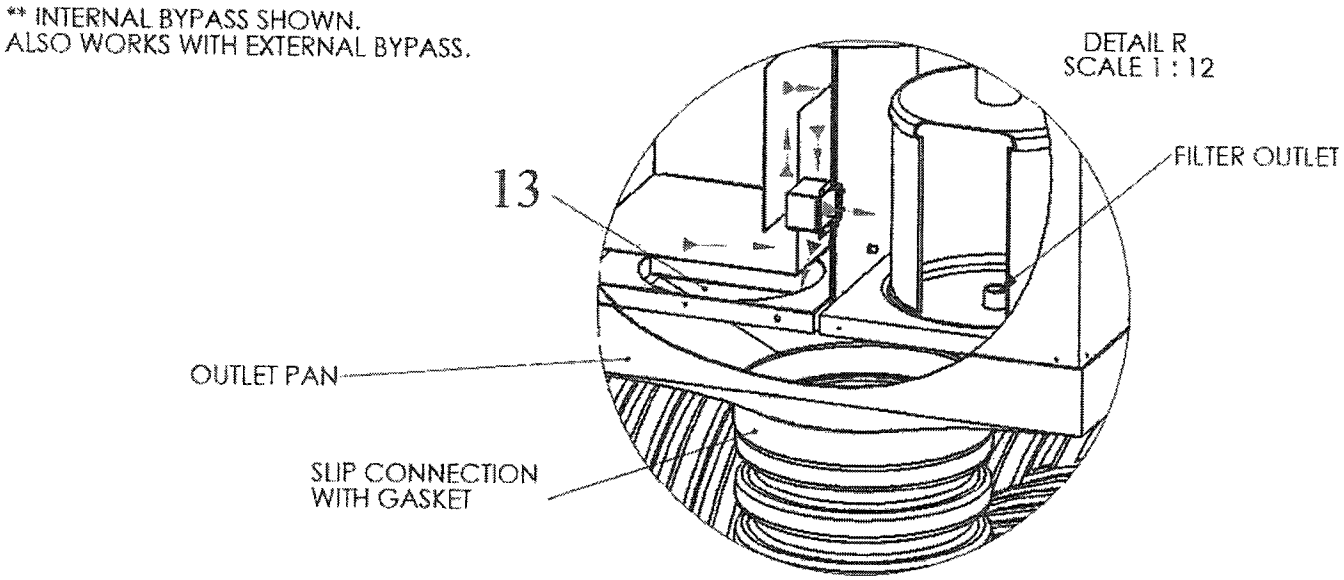
FIG. 8 illustrates a cross-sectional angled view of an internal high flow bypass according to one embodiment of the invention.

A more detailed drawing of an internal high flow bypass is shown in more detail in FIG. 8. The bypass outlet 13 opening forms a "false floor" located at the bottom of the inlet chamber. The opening in the "false floor" of the inlet chamber is about 16 inches in diameter. Bypass flows can also be directed to exit the pre-filtration system by way of a "false floor" beneath the filter cartridges in the filtration chamber (not shown). In one preferred embodiment, the pre-filtration system is designed to empty within 24 hours of each storm water event. These internal bypass systems may be used in both "vault" and "catch basin" assemblies (described above).

An external bypass system may also be implemented in the pre-filtration system. In one embodiment, bypass flow can be directed into a horizontal outlet pipe (not shown) connected to the floor or one or more side walls of the inlet chamber. The external bypass can also be located in the filtration chamber. During periods of high flow, bypass flows exit the pre-filtration system through the external bypass system, while filtered flows are directed to the filtration chamber and down into the water storage area.

During periods of high flow, the bypass flow can also exit through internal side plugs (not shown) that are connected to the floor or sides of the inlet chamber. The bypass flow is then directed to the outside of the pre-filtration system. The high flow can also be directed to another filtration system for treatment.

Figure 9:
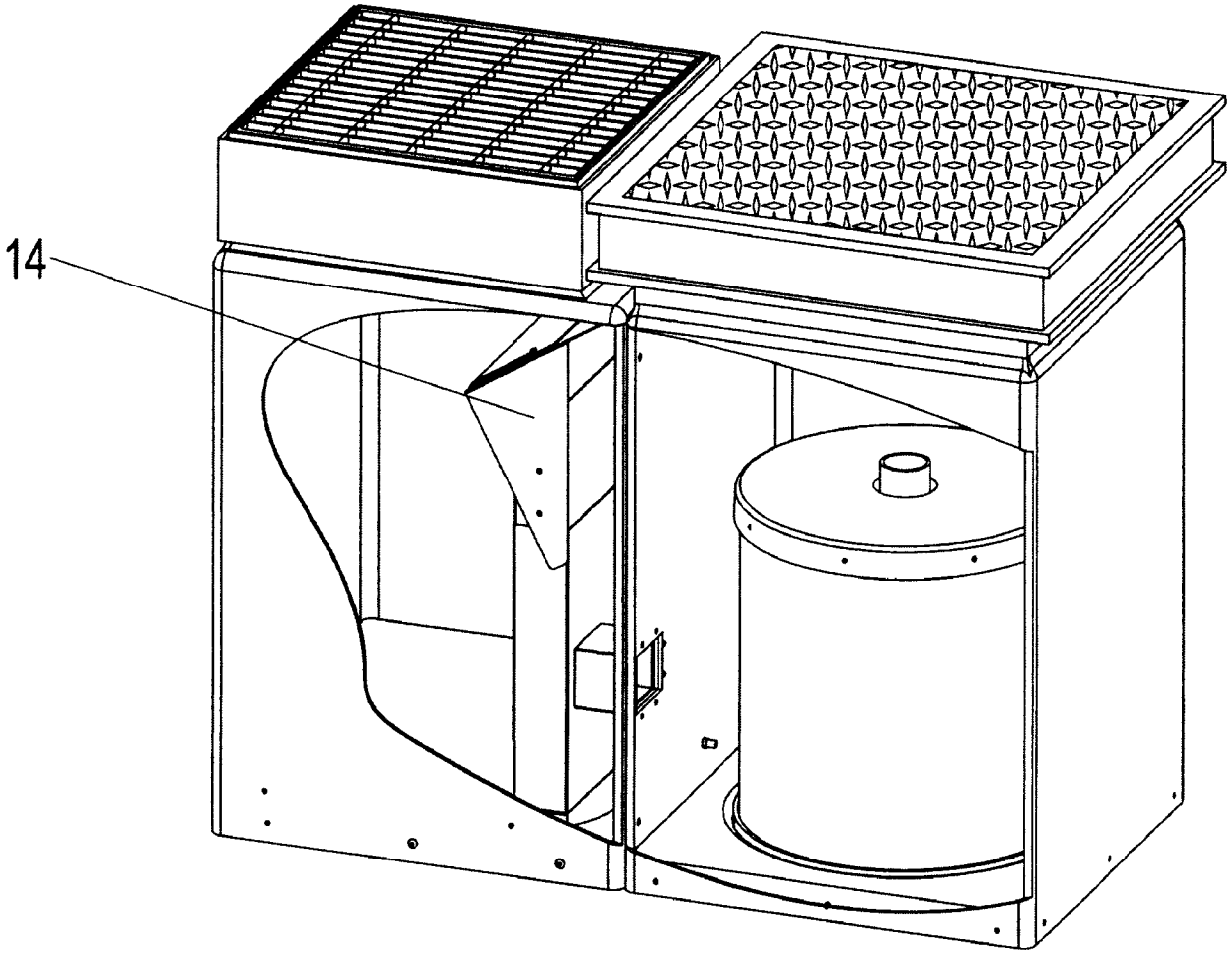
FIG. 9 illustrates a cross-sectional angled view of a pre-filtration system with adjustable risers and a ramp or hood structure forming part of the high flow bypass.

When an external bypass system is implemented, a sloped ramp or hood 14 may be incorporated onto one or more of the vertical walls of the baffle, as shown in FIG. 9. The ramp or hood 14 is located at or near the top of the walls of the baffle. The ramp or hood 14 forms a void between the two vertical walls to allow flow from the inlet chamber. During periods of high flow, the bypass flow is directed into the space beneath the two vertical walls 7 and 8, after which the bypass flow is allowed to exit the pre-filtration systems through one or more of horizontal pipes connected to a side wall of the inlet chamber, or through an alternative external bypass configuration system. First flush is allowed to exit through the external bypass or to the filtration chamber for treatment.

Figure 11:
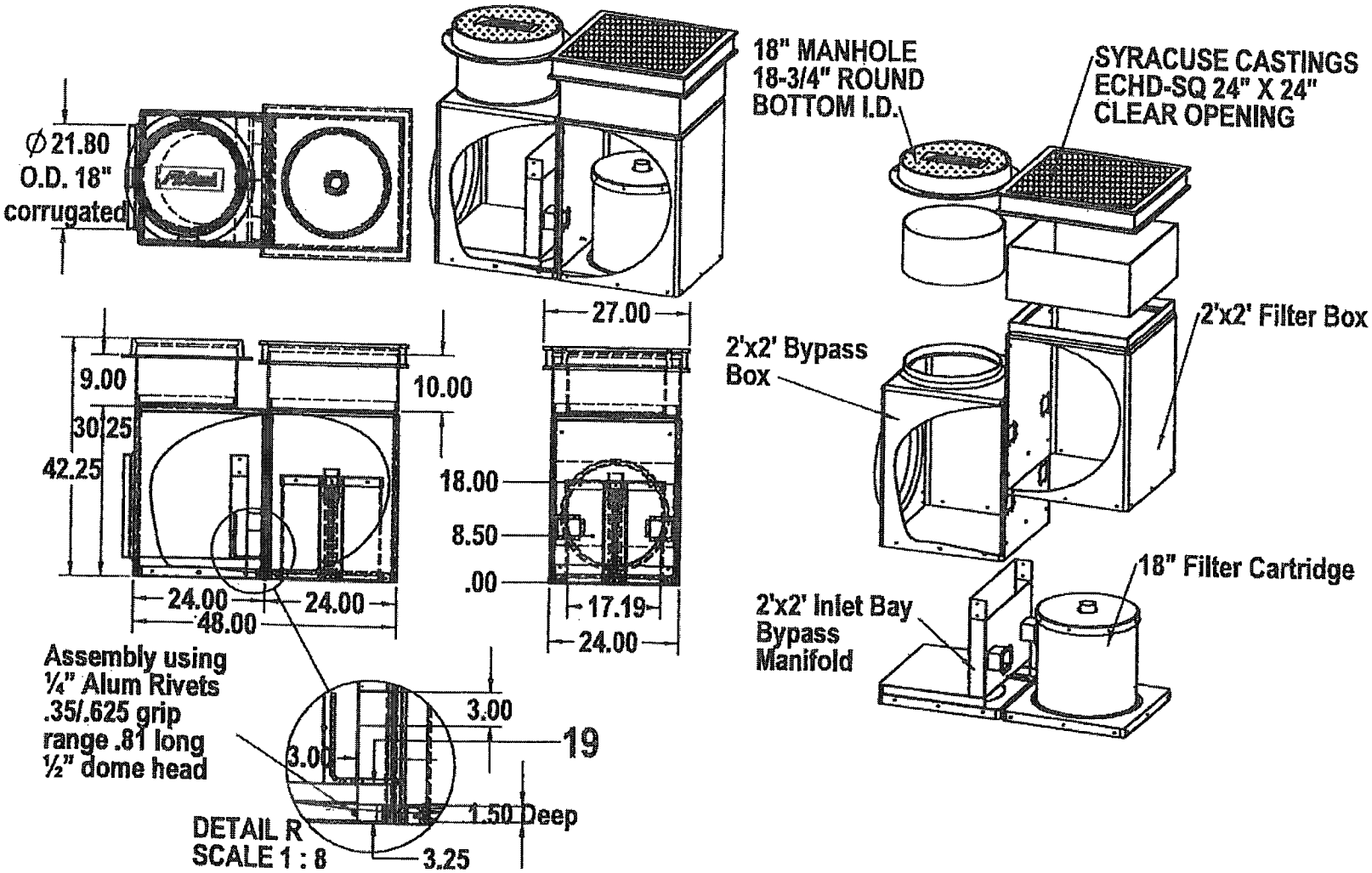
FIG. 11 illustrates a cross-sectional view of a pre-filtration system with a drain down tube.

The inlet chamber also includes a drain down tube 19, as shown in FIG. 11, to reduce standing water. The drain down tube is a perforated tube connecting the inlet chamber and filtration chamber. Standing water can lead to the accumulation of trapped pollutants and cause vectoring problems in the system. The drain down tube helps to reduce standing water by allowing the storm water to flow through the drain down tube from the inlet chamber and into the filtration system.

Figure 20:
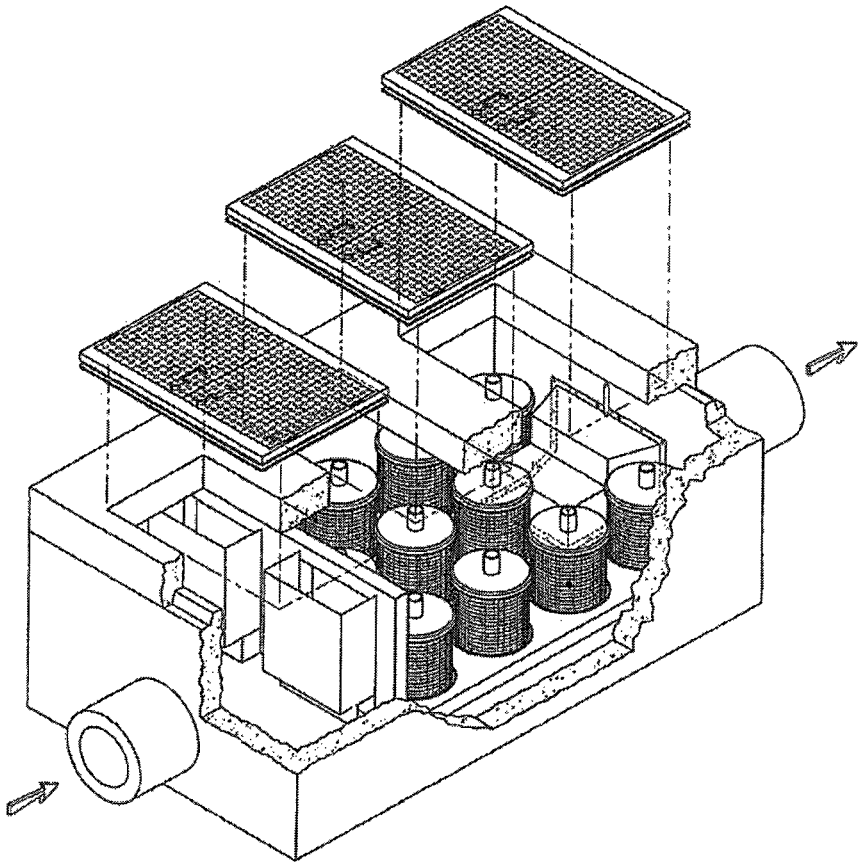
FIG. 20 illustrates the cross-sectional angled view of the pre-filtration system in a "catch-basin" assembly. High flow bypasses are between the inlet chamber and filtration chamber. A vented outlet hood, within the filtration chamber, is connected to the outlet pipe.
Figure 21:
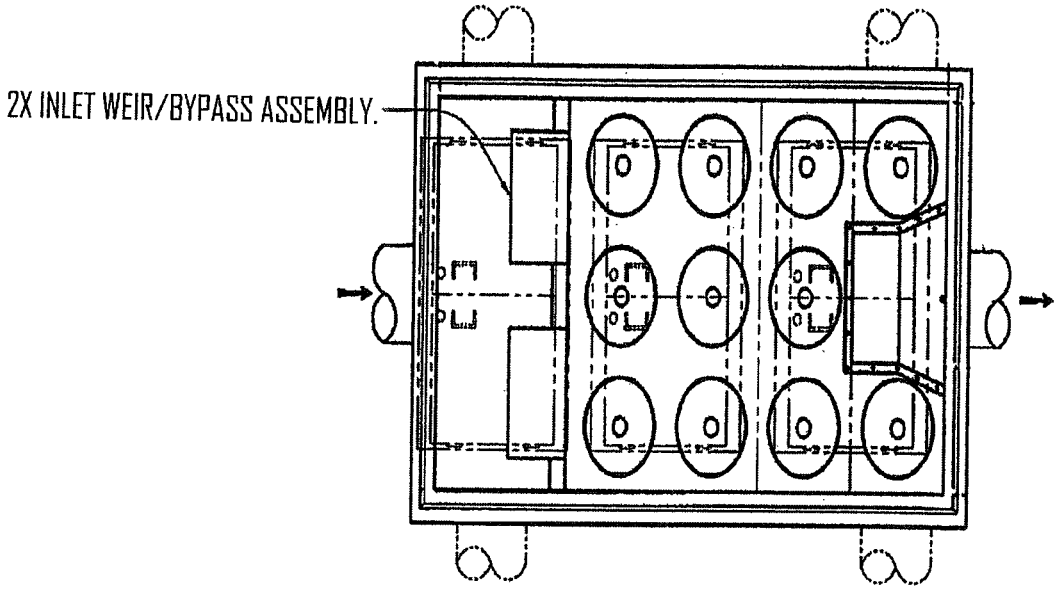
FIG. 21 illustrates the top view of the embodiment in FIG. 20.

In one embodiment, one high flow bypass is installed in the pre-filtration system, as illustrated in FIG. 1. In another embodiment, more than one internal bypass is installed in the pre-filtration system, as illustrated in FIGS. 20 and 21.

D. Adjustable Risers

Figure 10:
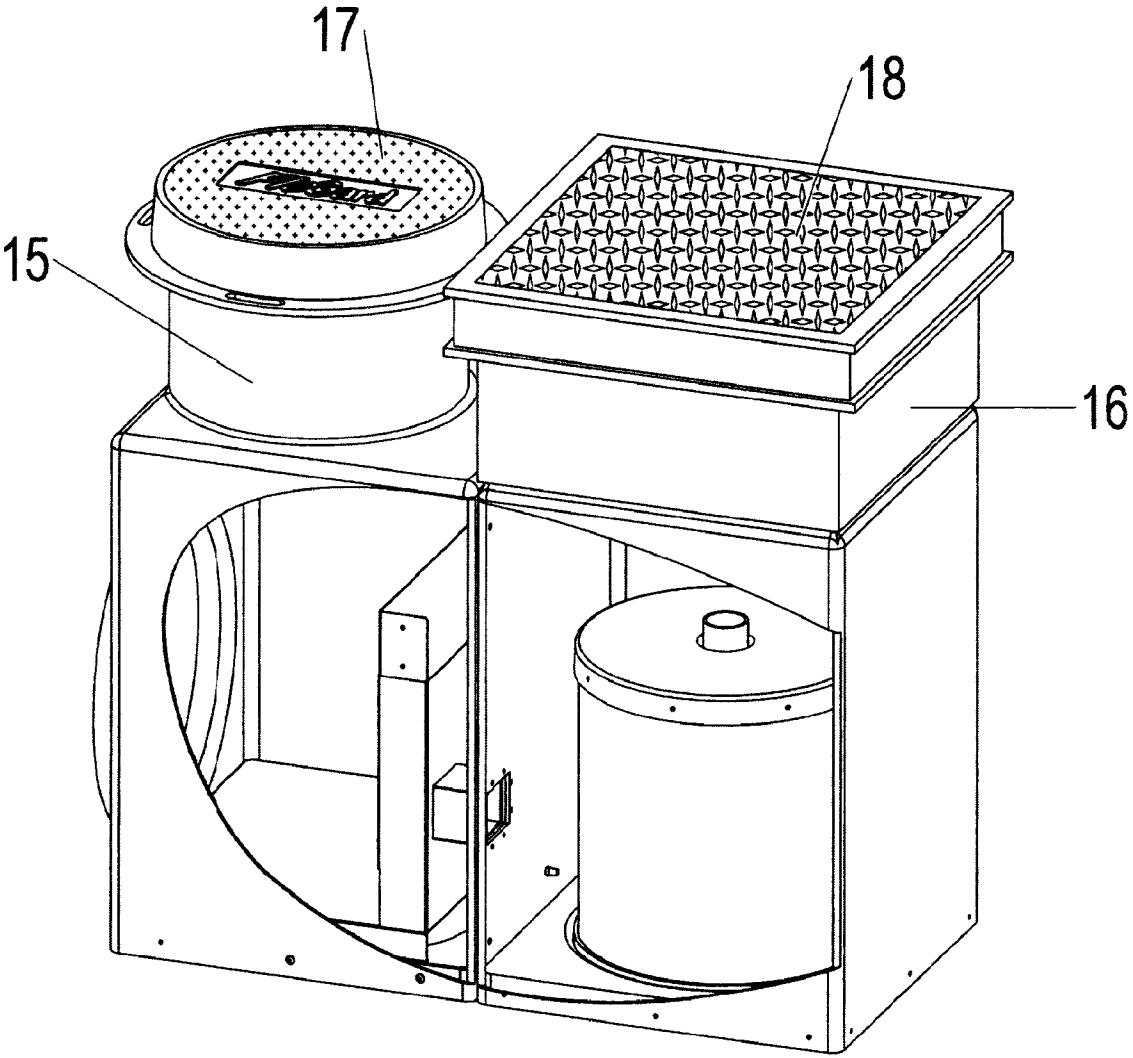
FIG. 10 illustrates a cross-sectional angled view of another pre-filtration system with adjustable risers.

To allow for added flexibility, the access covers of the pre-filtration system can be positioned on adjustable risers. As shown in FIG. 10, adjustable risers 15, 16 allow the adjustment of the depth of the pre-filtration system to match that of the finished surface. The adjustable risers 15, 16 can be cut in the field to the required height. The access covers 17, 18 of the inlet and filtration chambers, respectively, are set over these adjustable risers and a concrete collar is constructed at the field. This allows for the vehicle loads to be transferred to the concrete collar and thus to the surrounding soil, and not directly on the pre-filtration system.

II. Filter Assemblies

To allow for added flexibility, the inlet chamber and filtration chambers may be assembled in one of multiple configurations above a metered system. Factors that may determine the configuration include but are not limited to: desired overall size of the assembly, desired load-bearing tolerance for the assembly, the flow rate of the storm water, number and location of inlet and outlet pipes, number and location of pre-treatment zones and filtration systems, alignment with surface structures, and the desired placement of the access openings for inspection and maintenance purposes.

A. Single Cartridge Configuration

Figure 6:
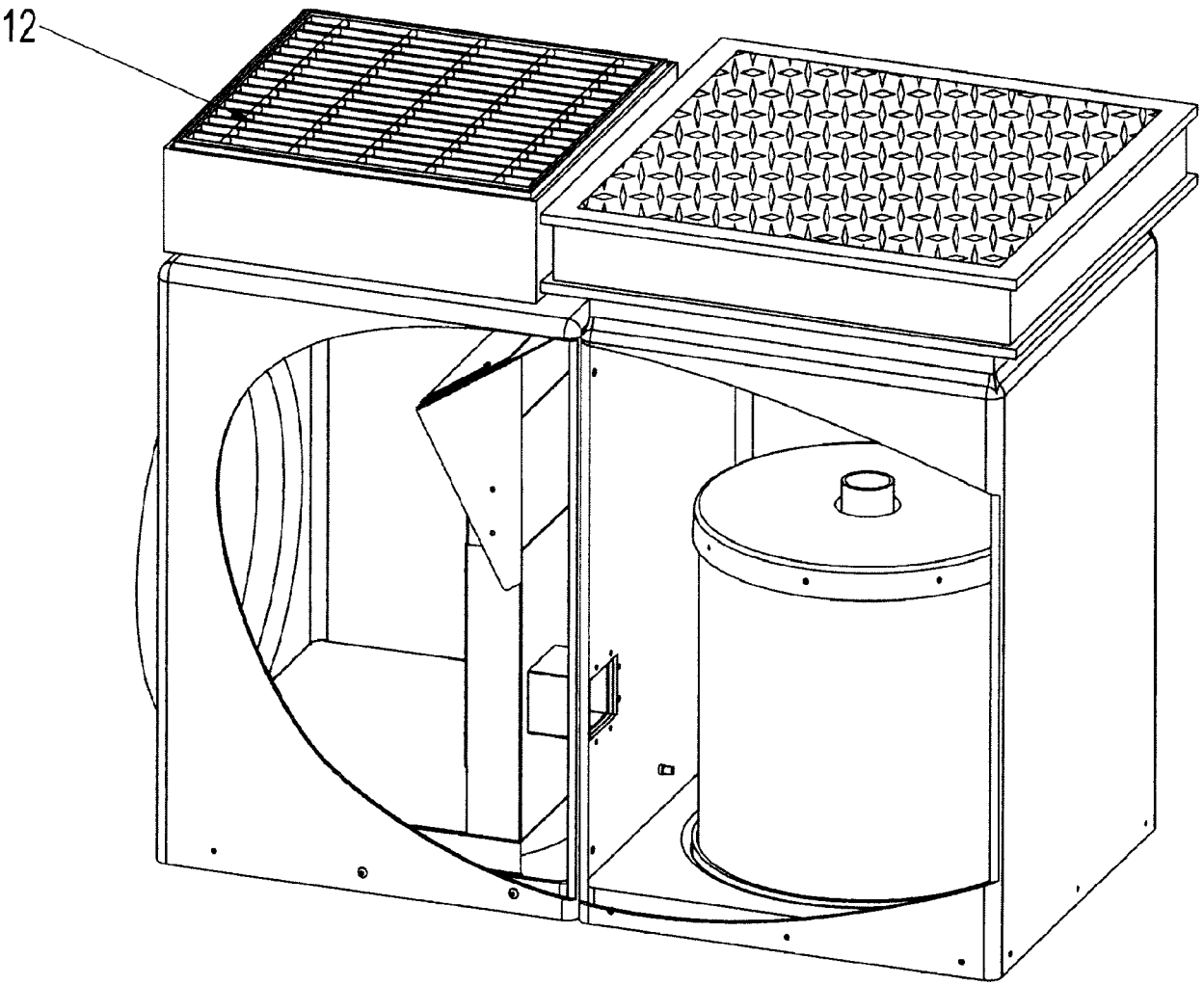
FIGS. 6 and 7 illustrate a cross-sectional angled view of the pre-filtration system in a "catch basin" assembly. The pre-filtration system has an inlet chamber with a substantially square inlet grate and internal components that form a high flow bypass. The pre-filtration system also has an adjacent filtration chamber containing the filtration cartridge and a square cover.

FIG. 1 illustrates an assembly comprising an inlet chamber. In a preferred embodiment, the assembly measures approximately 2 feet by 2 feet and a filtration chamber measuring approximately 2 feet in the horizontal direction and 2 feet in the lateral direction. The filtration chamber contains a single filtration cartridge. This configuration can also be used with a grated top cover panel, as shown in FIG. 6.

B. Two-Cartridge Configuration

Figure 2:
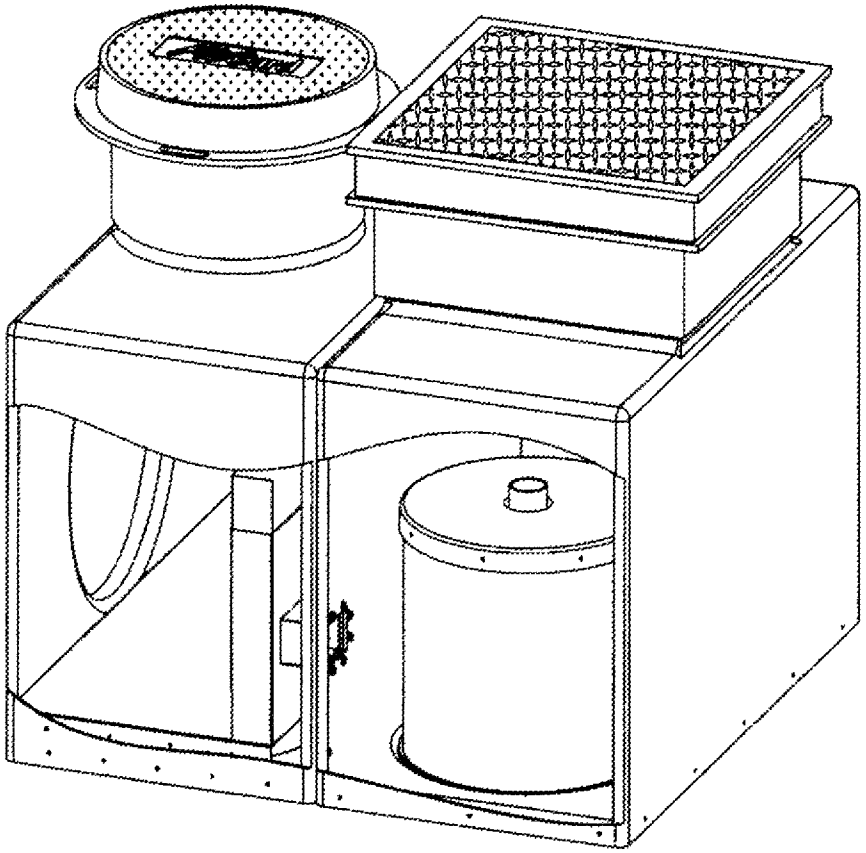

The pre-filtration system may also be sized to include two filtration cartridges to accommodate higher storm water flow rates. The pre-filtration system can include two cylindrical filtration cartridges arranged in a lengthwise "row" in the filtration chamber. One filtration cartridge can be located at one end of the filtration chamber (as shown in FIG. 2), while the second filtration cartridge can be located at another end (not shown). In one embodiment, the cylindrical filtration cartridges each measures approximately 18 inches in diameter. In one embodiment, the inlet chamber and filtration chamber both measure approximately 2 feet in the horizontal direction and 4 feet in the lateral direction.

Figure 3:
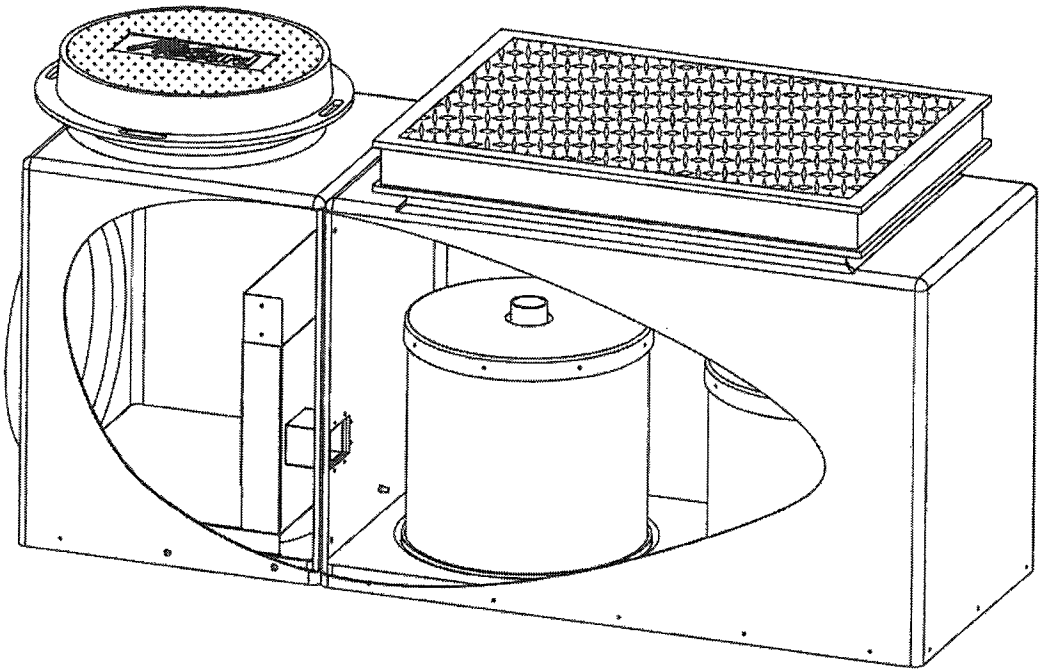
Figure 7:
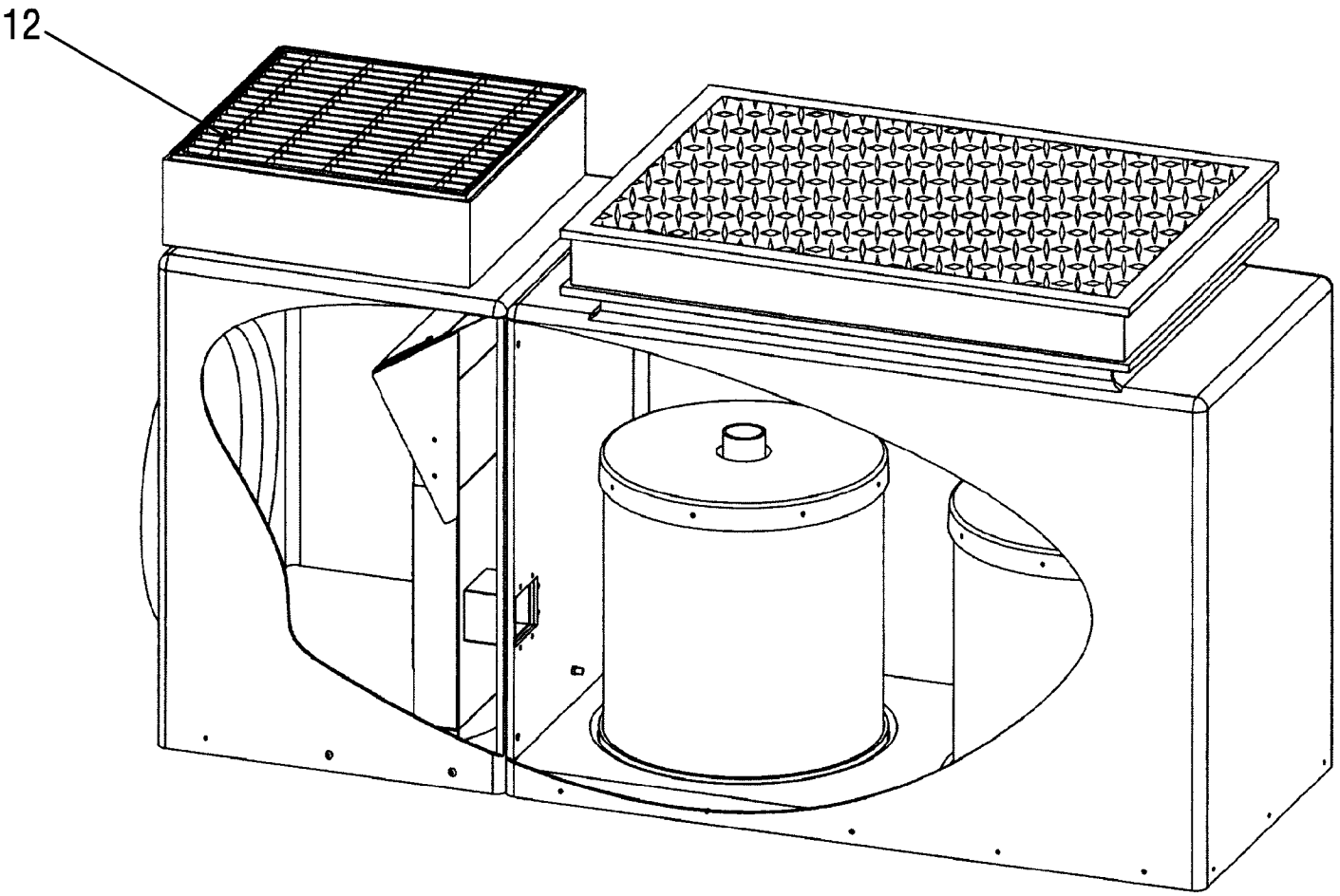

For a narrower "trench-like" landscape, the two cylindrical filtration cartridges could also be arranged in a side-by-side configuration. One filtration cartridge can be located at one side of the filtration chamber (as shown in FIG. 3), while the second filtration cartridge can be located at another side (partially shown). In one embodiment, the cylindrical filtration cartridges each measures approximately 18 inches in diameter. In one embodiment, the inlet chamber can measure approximately 2 feet in the horizontal direction and 2 feet in the lateral direction. In this embodiment, the filtration chamber can measure approximately 2 feet in the horizontal direction and 4 feet in the lateral direction. This configuration can also be used with a grated top cover panel, as shown in FIG. 7.

C. Four-Cartridge Configuration

Figure 4:
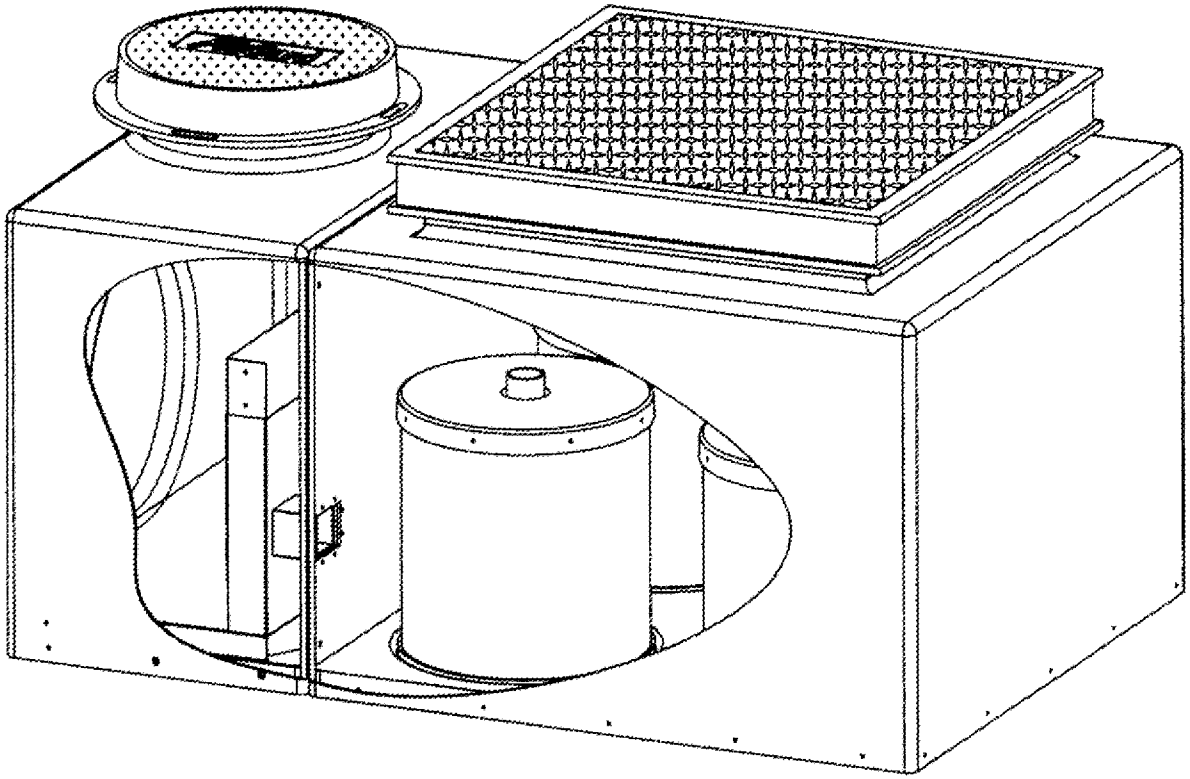
Figure 5:
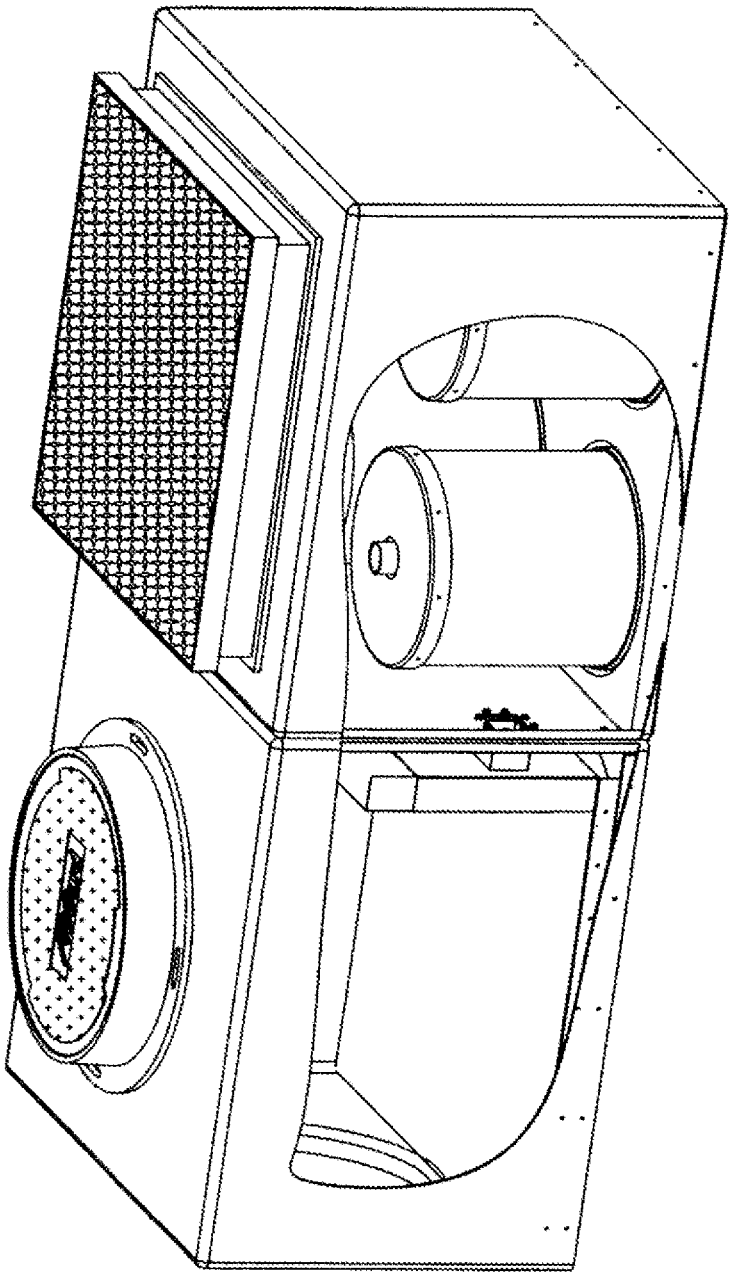

The pre-filtration system may also be sized to include four filtration cartridges to accommodate even higher storm water flow rates. The pre-filtration system can include four cylindrical filtration cartridges arranged in a square configuration (each approximately 18 inches in diameter) in the filtration chamber. Two filtration cartridges can be placed in a row along one side of the filtration chamber (as shown in FIG. 4), while two additional filtration cartridges can be placed in a row along another side (not shown). In one embodiment, the inlet chamber measures approximately 2 feet in the horizontal direction and 4 feet in the lateral direction. In this embodiment, the filtration chamber measures approximately 4 feet in the horizontal direction and 4 feet in the lateral direction.

D. Additional Configurations

The above configurations are provided by way of example only. Additional filtration cartridges (and inlet and filtration chamber sizes) may be used to accommodate different storm water flow rates and levels of contaminants. In one embodiment, the filtration cartridges are arranged in a single layer. In another embodiment, the filtration cartridges may be stacked, increasing the filtration capacity without increasing the system footprint. This is a critical feature for sites with restricted area and a smaller footprint is a less expensive installation.

Figure 19:
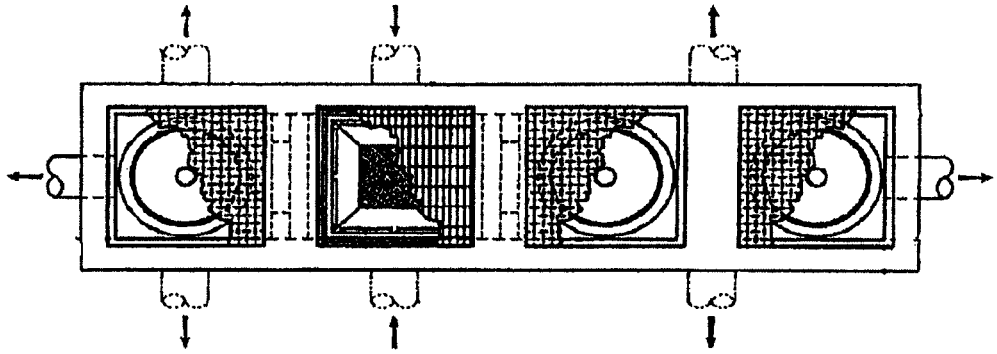
FIG. 19 illustrates top and cross-sectional views of an embodiment of the present invention. Scheme A is the top view of the assembly and depicts the bilateral configuration of the filtration cartridges in relation to the inlet chamber. Scheme B is the cross-sectional view of the assembly and depicts the bilateral configuration of the filtration cartridge in relation to the inlet chamber.
Figure 19:
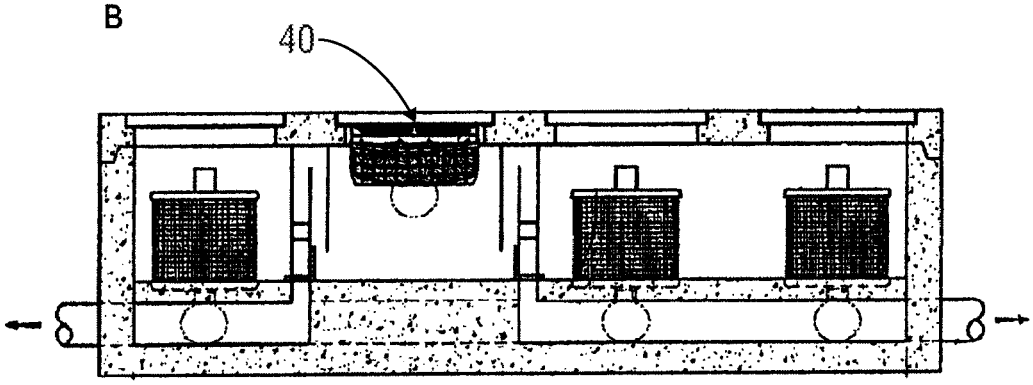

In another embodiment, as illustrated in FIGS. 1 to 7, the filtration cartridge(s) and the filtration chamber may be placed on either side of the inlet chamber, and create an "end grate configuration." In another embodiment, as illustrated in FIGS. 18 and 19, the filtration cartridges and the filtration chambers may be placed on both ends of the inlet chamber, and create a "bilateral configuration."

Figure 16:
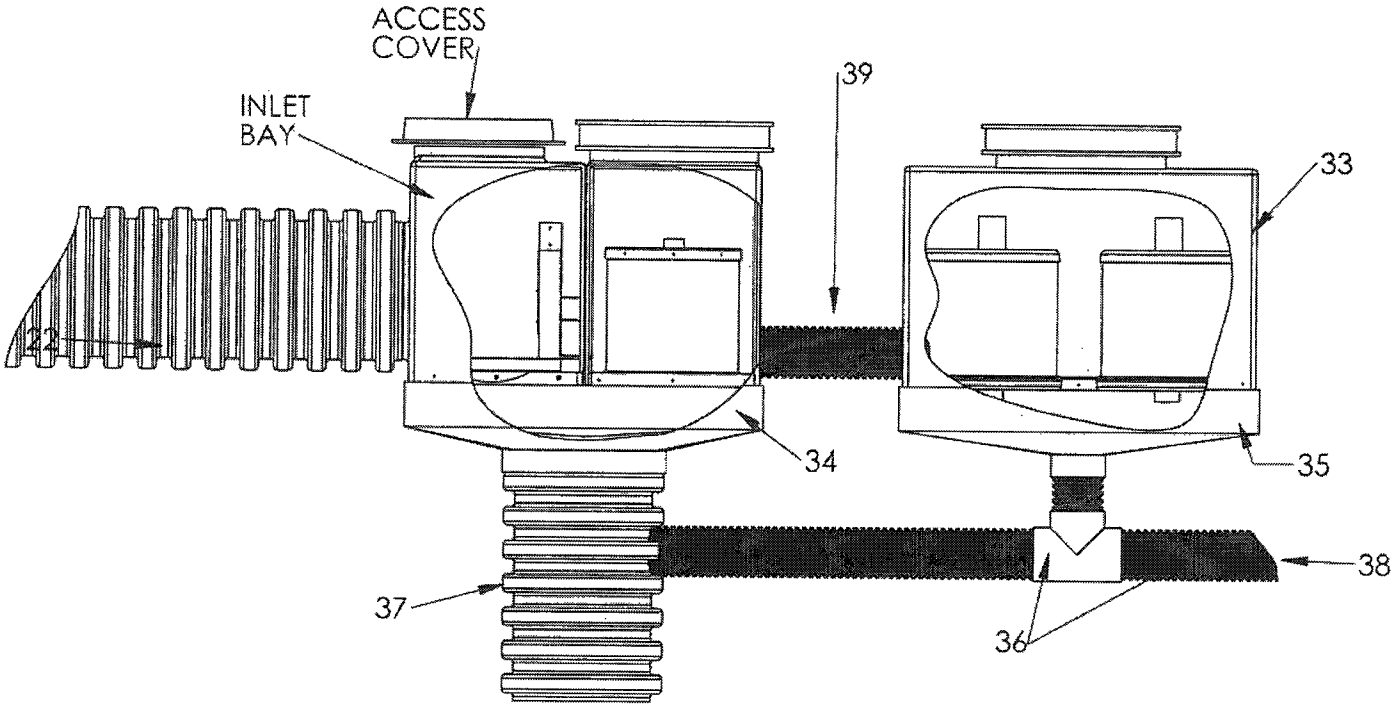
FIG. 16 illustrates a cross-sectional view of the pre-filtration system above a pipe manifold detention or retention system with a supplemental filtration chamber. The supplemental filter chamber is set directly over an outlet pan, which is connected to a riser pipe by an outlet connector pipe.

In one embodiment, two cartridges can filter about 32 gallons of storm water per minute. Thus, depending on the eventual flow and filtration requirements for a given land development, an engineer can determine the number of filtration cartridges required to treat the storm water flow prior to the commencement of construction. As shown in FIG. 16, a single inlet chamber could also direct storm water to multiple filtration chambers.

For additional capacity, an inlet chamber measuring approximately 4 feet in the horizontal direction and 4 feet in the lateral direction may be used in connection with one to five different filtration chambers (each containing four cylindrical filtration devices). In this embodiment, the pre-filtration device can be used with as many as twenty cylindrical filtration devices.

In addition, a single inlet chamber may be adapted for use with different filtration chambers. This modular feature allows for the use of pre-fabricated components that can be combined in different ways. In this way, an engineer can tailor the pre-filtration system (different combinations of inlet and filtration chambers) for different surface structures and land development sites using pre-fabricated components. This can reduce the overall cost and time for manufacture and installation.

III. Installation Over Different Water Detention or Management Systems

Figure 14:
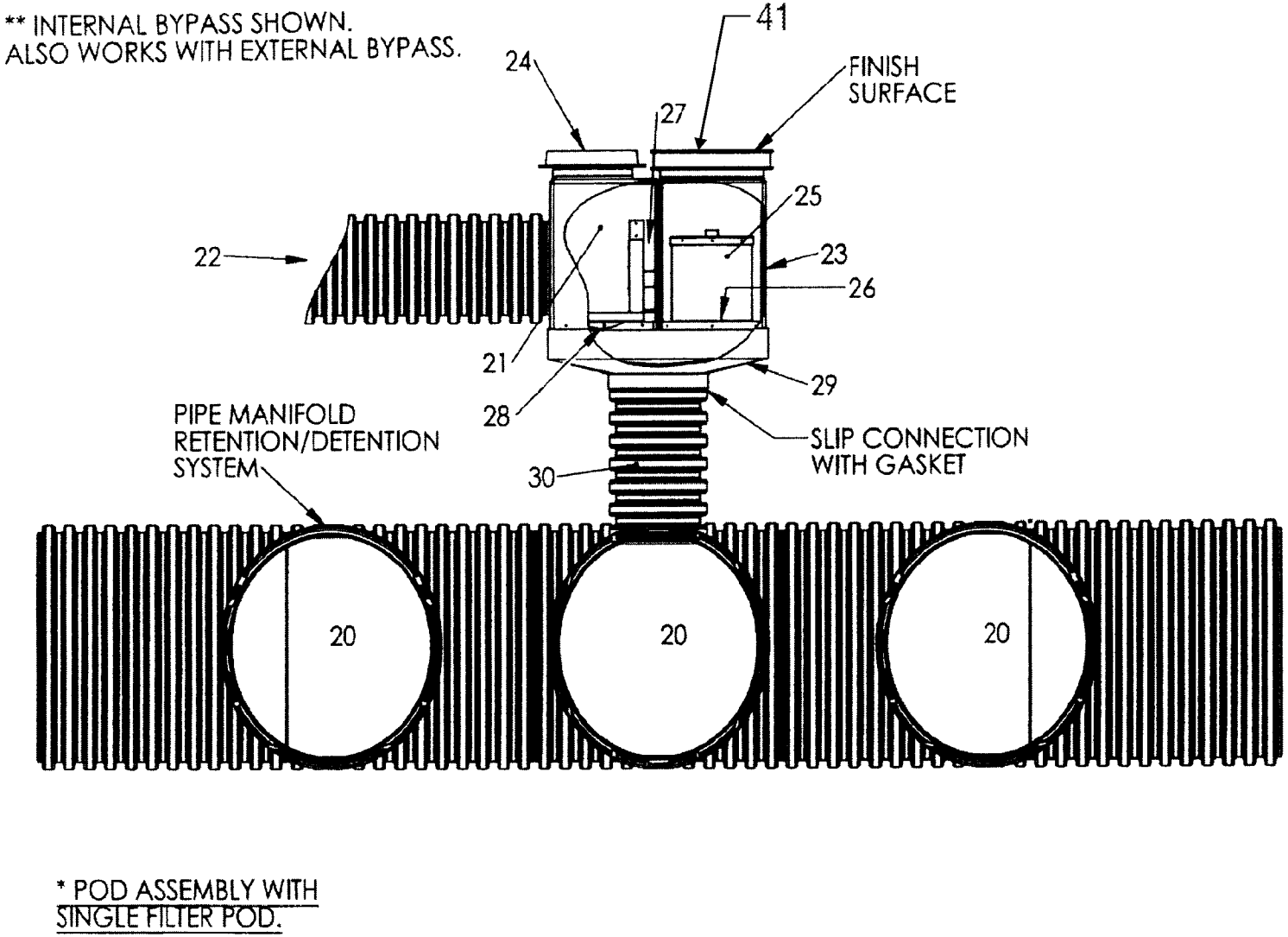
FIG. 14 illustrates a cross-sectional view of an embodiment of the pre-filtration system above a pipe manifold detention and/or retention system. The pre-filtration system is placed over an outlet pan, which receives the storm water from the inlet chamber and the filtration chamber. The outlet pan is connected to a riser pipe, which drains into the pipe manifold storage system.

In addition to the cubic or "milk crate" metered systems shown in FIGS. 12, 13 and 17, the pre-filtration system may also be installed over a pipe manifold system. As shown in FIG. 14, the pre-filtration system includes an inlet chamber 21 with an opening along a side wall to receive incoming water from an inlet pipe 22. The pre-filtration system also includes a filtration chamber 23 through which storm water is treated by one or more various filtration media known in the art. There are access covers 24 and 41 placed above both the inlet and filtration chambers, respectively.

The pre-filtration system empties into a pipe manifold system, which includes a series of horizontal pipes located underground 20. The pipe manifold system may be connected to one or more outlets of the pre-filtration system using a riser pipe 30. Alternatively, when a shallower configuration is desired, the pre-filtration system may rest directly over the pipe manifold system. The outlet of the pre-filtration system is directed vertically into the storage area instead of connecting into the riser pipe.

During normal use, storm water flows from the inlet pipe 22 into an opening along the side of the inlet chamber 21. Normal flow passes into the filtration chamber 23, where it is then filtered by one or more filtration cartridges 25. The filtered flow exits the pre-filtration system through an opening in the floor of the filtration system 26. Further, during periods of high flow, storm water is allowed to accumulate in the inlet chamber until it enters the space between the vertical walls of the baffle 27. The bypass flow is then allowed to exit the pre-filtration system by way of an opening in the inlet chamber 28.

Figure 15:
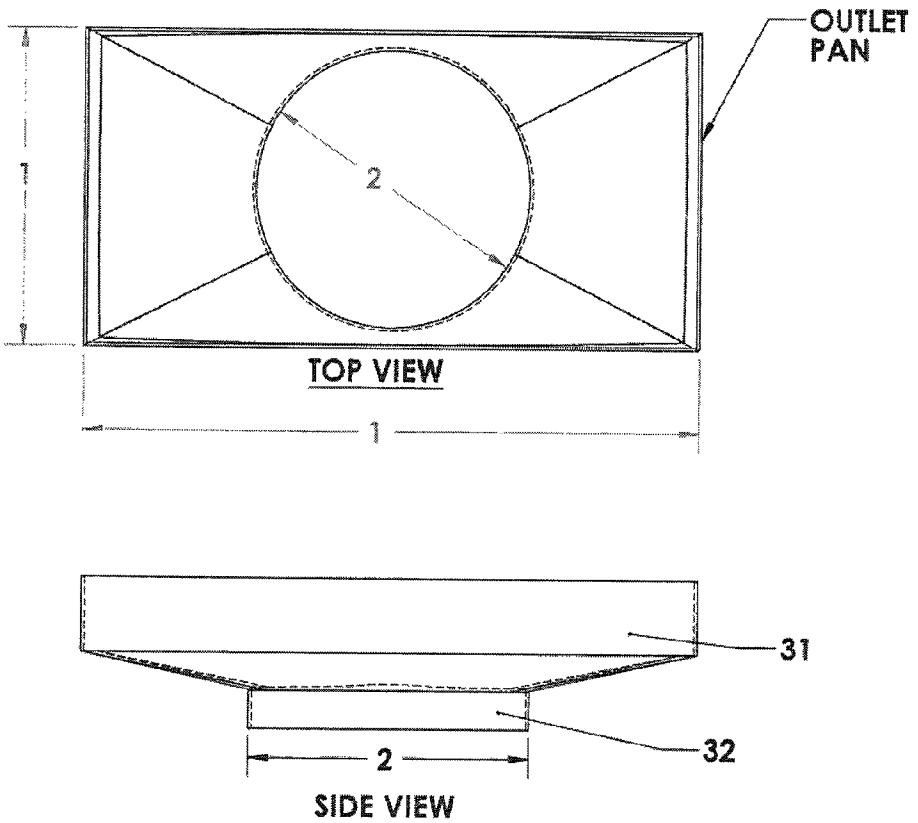
FIG. 15 illustrates the top view and side view of an outlet pan.

An outlet pan 29 collects the filtered and bypass flows. An example of an outlet pan of the pre-filtration system is shown in FIG. 15. The top part of the outlet pan 31 is shaped and sized to receive storm water flow from one or more bottom surfaces of the pre-filtration system. The lower part of the outlet pan 32 is shaped and sized to slip connect to a riser pipe, gasket connection, or flexible connector.

Multiple (or supplemental) filtration chambers can be used to treat storm water over a pipe manifold system. As illustrated in FIG. 16, the pre-filtration system is connected to one or more supplemental filtration chambers 33 by a connector pipe 39 and/or by bolts (not shown). Alternatively, the filtration chambers can be connected side by side without a pipe. In either configuration, the filtered flow from the supplemental filtration chamber 33 is directed downward around the perimeter of the filter cartridge case to outlet pan 35. Filtered flow from the supplemental filtration chamber travels through an outlet connector pipe 36 into the riser pipe 37. The filtered flow then flows into the underlying water storage pipe system. Storm water 38 flowing from additional filtration chambers (not shown) may also empty into the same riser pipe 37 and accumulate in the underlying water storage pipe system.

This configuration is also applicable when there is a surface feature that will interfere with the pre-treatment configuration. In other words, a connector pipe 39 can be used to connect two filtration chambers located at a distance from each other. In addition, in this configuration, the pre-filtration system can reduce the size and filtration load of any given pre-filtration system by splitting the flow of storm water to different filtration chambers. By connecting the filtration chambers together, the storm water levels can rise and fall at approximately the same time in all the connected filtration chambers. This equalizes the flow and filtration load in all filtration chambers.

In another embodiment, the pre-filtration system may be installed over a chamber style system containing half an arch. In another embodiment, the pre-filtration system can be used in connection with a bioretention system or a conventional "tree box filter." In yet another embodiment, the pre-filtration system can be used with other filtration systems, such as a grassy swale pre-filter. This is shown in FIG. 17.

The ordinary artisan will recognize that the absolute dimensions of the openings in the pre-filtration system can be selected to accept industry standard pipe connections and fittings (e.g., rubber boots). Such fittings can offer flexible and watertight connections between modular systems and control piping for controlling water flow into and out of an assembled pre-filtration system. There need not be a mechanical connection between the pre-filtration system and the subsequent system to which the storm water is directed. Rather, in one embodiment, the pre-filtration system can be placed over the metered systems with a hydraulic seal between the pre-filtration system and one or more metered systems. The hydraulic seal can be formed using any of the methods known in the art, for example, using mastic, caulking, sealant or adhesive compositions.

The above features offer increased flexibility to a design engineer. As discussed, the modular nature of the pre-filtration system allows for the placement of inlet chambers and filtration chambers anywhere over the top (directly or indirectly) of a water storage area.

The above disclosure is sufficient to enable one of ordinary skill in the art to practice the invention, and provides the best mode of practicing the invention presently contemplated by the inventor. While there is provided herein a full and complete disclosure of specific embodiments of this invention, it is not desired to limit the invention to the exact construction, dimensional relationships, and operation shown and described. Various modifications, alternative constructions, design options, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

What is claimed is:

1. An apparatus for pre-filtering storm water entering an underground storm water management system comprising:

(a) an inlet chamber comprising: (i) an inlet opening, (ii) a chute extending from a first bottom portion of the inlet chamber, the chute comprising a front wall, a back wall separate from the front wall, and a side opening along the back wall, and (iii) a bypass opening along a second bottom portion of the inlet chamber, downstream from the front and back walls, said bypass opening extending through the inlet chamber, adjacent to the first bottom portion; and (b) a filtration chamber adjacent to the inlet chamber, the filtration chamber comprising filtration medium and one or more outlet openings;

wherein the inlet opening, side opening of the chute, and filtration chamber define a primary flow route when storm water accumulates between the walls of the chute; and further wherein the inlet opening and bypass opening define an alternate flow route when storm water accumulates above at least one of the walls of the chute.

2. The apparatus of claim 1, wherein a bottom edge of the front wall is separated from the first bottom portion of the inlet chamber by a space.

3. The apparatus of claim 1, wherein the back wall is lower in height than the front wall.

4. The apparatus of claim 1, wherein the chute further comprises a sloped ramp along a top portion of the chute.

5. The apparatus of claim 1, further comprising a drain down tube connecting the inlet chamber and the filtration chamber.

6. The apparatus of claim 1, wherein the inlet chamber further comprises a grated cover panel along a top portion of the inlet chamber.

7. The apparatus of claim 1, wherein the inlet chamber further comprises a catch basin filter disposed along a top surface of the inlet chamber.

8. The apparatus of claim 1, further comprising one or more adjustable risers above at least one of the inlet chamber and the filtration chamber.

9. The apparatus of claim 1, further comprising one or more access covers above at least one of the inlet chamber and the filtration chamber.

10. The apparatus of claim 1, wherein the inlet chamber further comprises a false floor.

11. The apparatus of claim 1, wherein the filtration chamber further comprises a false floor.

12. The apparatus of claim 1, wherein the apparatus is disposed directly above a storm water retention system.

13. The apparatus of claim 1, wherein the apparatus is disposed directly above one or more half-arched chambers.

14. The apparatus of claim 1, wherein at least one of the inlet chamber and filtration chamber is disposed above a pipe manifold system.

15. The apparatus of claim 14, wherein the filtration chamber is connected to a pipe manifold system through an outlet pan and a slip connection comprising a gasket and a riser pipe.

16. The apparatus of claim 1, further comprising one or more supplemental filtration chambers connected to an outlet opening of the filtration chamber.

17. A method of pre-filtering storm water, comprising the steps of:

(a) passing storm water through an inlet chamber comprising: one or more inlet openings; a chute extending from a first bottom portion of the inlet chamber, the chute comprising a front wall, a back wall separate from the front wall, and a side opening along the back wall; and a bypass opening along a second bottom portion of the inlet chamber, downstream from the front and back walls, said bypass opening extending through the inlet chamber, adjacent to the first bottom portion;

(b) allowing storm water to accumulate in the chute of the inlet chamber;

(c) directing storm water accumulating in the chute from the side opening of the chute to an adjacent filtration chamber comprising filtration media;

(d) releasing filtered storm water from the filtration chamber;

(e) directing storm water accumulating above at least one of the walls of the chute to the bypass opening in the inlet chamber; and releasing unfiltered storm water from the inlet chamber through the bypass opening.

18. The method of claim 17, wherein a bottom edge of the front wall is separated from the first bottom portion of the inlet chamber by a space.

19. The method of claim 17, wherein the back wall is lower in height than the front wall.

20. The method of claim 17, wherein the chute further comprises a sloped ramp along a top portion of the chute.

21. The method of claim 17, wherein the inlet chamber further comprises a catch basin filter disposed along a top surface of the inlet chamber, and the step of passing storm water through an inlet chamber further comprises allowing fluid to flow from the inlet opening through a catch basin filter.

22. The method of claim 17, wherein the inlet chamber further comprises a drain down tube connecting the inlet chamber and the filtration chamber.

23. The method of claim 17, wherein the inlet chamber further comprises a grated cover panel along a top portion of the inlet chamber.

24. The method of claim 17, wherein the filtration chamber further comprises one or more adjustable risers disposed along a top surface.

25. The method of claim 17, further comprising the step of retaining pollutants in the inlet chamber.

26. The method of claim 25, further comprising the step of removing pollutants via one or more top access openings.

27. The method of claim 17, wherein the inlet chamber further comprises a false floor.

28. The method of claim 17, wherein the filtration chamber further comprises a false floor.

29. The method of claim 17, further comprising the step of releasing filtered storm water to a storm water retention system.

30. The method of claim 17, further comprising the step of releasing filtered storm water to one or more half-arched chambers.

31. The method of claim 17, wherein at least one of the inlet chamber and filtration chamber is disposed above a pipe manifold system.

32. The method of claim 31, wherein the filtration chamber is connected to a pipe manifold system through an outlet pan and a slip connection comprising a gasket and a riser pipe.

33. The method of claim 17, further comprising the step of directing storm water accumulating in the chute to a supplemental filtration chamber.

34. An apparatus for pre-filtering storm water entering an underground storm water management system comprising:

(a) an inlet chamber comprising an inlet opening, four side walls, a first weir adjoining opposite side walls, a second weir separate from and substantially parallel to the first weir, a side opening along the second weir, a bottom surface, and a bypass opening along the bottom surface, downstream from the first and second weirs, wherein the side opening of the second weir is adapted to transmit storm water accumulating between the first and second weirs, and further wherein the bypass opening is adapted to transmit storm water flowing over a top edge of at least one of the weirs into a space adjacent to the inlet chamber; and (b) a filtration chamber adapted to receive storm water transmitted from the side opening of the second weir, the filtration chamber comprising filtration medium and one or more outlet openings.

35. The apparatus of claim 34, wherein a bottom edge of the first weir is separated from the bottom surface of the inlet chamber by a space.

36. The apparatus of claim 34, wherein the second weir is lower in height than the first weir.

37. The apparatus of claim 34, wherein the first weir comprises a sloped ramp along a top portion of the weir.

38. The apparatus of claim 34, further comprising a drain down tube connecting the inlet chamber and the filtration chamber.

39. The apparatus of claim 34, wherein the inlet chamber comprises a grated cover panel along a top portion of the inlet chamber.

40. The apparatus of claim 34, wherein the inlet chamber further comprises a catch basin filter disposed along a top surface of the inlet chamber.

41. The apparatus of claim 34, further comprising one or more adjustable risers above at least one of the inlet chamber and the filtration chamber.

42. The apparatus of claim 34, further comprising one or more access covers above at least one of the inlet chamber and the filtration chamber.

43. The apparatus of claim 34, wherein the bottom surface of the inlet chamber comprises a false floor.

44. The apparatus of claim 43, wherein the filtration chamber further comprises a false floor.

45. The apparatus of claim 34, wherein the apparatus is disposed directly above a storm water retention system.

46. The apparatus of claim 34, wherein the apparatus is disposed directly above one or more half-arched chambers.

47. The apparatus of claim 34, wherein at least one of the inlet chamber and filtration chamber is disposed above a pipe manifold system.

48. The apparatus of claim 47, wherein the filtration chamber is connected to a pipe manifold system through an outlet pan and a slip connection comprising a gasket and a riser pipe.

49. The apparatus of claim 34, further comprising one or more supplemental filtration chambers connected to an outlet opening of the filtration chamber.

* * * * *